US011472185B2

(12) United States Patent
Yamaguchi et al.

(10) Patent No.: US 11,472,185 B2
(45) Date of Patent: Oct. 18, 2022

(54) LIQUID EJECTING APPARATUS AND MAINTENANCE METHOD FOR LIQUID EJECTING APPARATUS

(71) Applicant: SEIKO EPSON CORPORATION, Tokyo (JP)

(72) Inventors: Masanobu Yamaguchi, Matsumoto (JP); Naoki Yokoyama, Shiojiri (JP); Hitotoshi Kimura, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 17/159,226

(22) Filed: Jan. 27, 2021

(65) Prior Publication Data

US 2021/0237451 A1 Aug. 5, 2021

(30) Foreign Application Priority Data

Jan. 30, 2020 (JP) ..... JP2020-013349

(51) Int. Cl.
*B41J 2/165* (2006.01)

(52) U.S. Cl.
CPC ..... *B41J 2/16552* (2013.01); *B41J 2/16535* (2013.01); *B41J 2002/16558* (2013.01)

(58) Field of Classification Search
None
See application file for complete search history.

(56) References Cited

U.S. PATENT DOCUMENTS 10,086,615 B2 * 10/2018 Nakano ..... B41J 2/16535
2009/0046123 A1 2/2009 Muraoka
2012/0218346 A1 8/2012 Inoue
2014/0253633 A1 9/2014 Kobayashi et al.
2015/0191018 A1 * 7/2015 Ozaki ..... B41J 2/16588 347/33
2017/0334209 A1 11/2017 Nakano
2018/0264822 A1 9/2018 Tanioku et al.

FOREIGN PATENT DOCUMENTS

| | | | |
|---|---|---|---|
| JP | 2009-045802 | A | 3/2009 |
| JP | 2012-171345 | A | 9/2012 |
| JP | 2014-159112 | A | 9/2014 |
| JP | 2016-040130 | A | 3/2016 |
| JP | 2017-205954 | A | 11/2017 |
| JP | 2017-213823 | A | 12/2017 |
| JP | 2018-154123 | A | 10/2018 |
| JP | 2019-025658 | A | 2/2019 |
| JP | 2019-162824 | A | 9/2019 |

* cited by examiner

*Primary Examiner* — Alejandro Valencia
(74) *Attorney, Agent, or Firm* — Workman Nydegger

(57) ABSTRACT

A liquid ejecting apparatus includes: a liquid ejecting portion configured to eject a liquid from a nozzle disposed in a nozzle surface; a wiping mechanism configured to execute a wiping operation of wiping the nozzle surface with a strip-shaped member, which is configured to absorb the liquid ejected by the liquid ejecting portion, in contact with the nozzle surface; a wiping solution supply mechanism configured to supply a wiping solution to the strip-shaped member before the wiping operation is performed; and a control portion, and the control portion reduces the amount of the wiping solution held in the strip-shaped member in the wiping operation when the nozzle surface with a large amount of the liquid adhering thereto is wiped as compared with the amount of the wiping solution when the nozzle surface with a small amount of the liquid adhering thereto is wiped.

3 Claims, 10 Drawing Sheets

LIQUID EJECTING APPARATUS AND MAINTENANCE METHOD FOR LIQUID EJECTING APPARATUS

The present application is based on, and claims priority from JP Application Serial Number 2020-013349, filed Jan. 30, 2020, the disclosure of which is hereby incorporated by reference herein in its entirety.

BACKGROUND

1. Technical Field

The present disclosure relates to a liquid ejecting apparatus such as a printer and a maintenance method for a liquid ejecting apparatus.

2. Related Art

As described in JP-A-2018-154123, there is a printer as an example of a liquid ejecting apparatus configured to eject a liquid from a liquid ejecting head as an example of a liquid ejecting portion to perform printing. The printer includes a wiping-off mechanism as an example of a wiping mechanism configured to wipe off a nozzle surface of the liquid ejecting head, and the nozzle surface is wiped off with a web as an example of a strip-shaped member to which a cleaning solution as an example of a wiping solution is applied.

Even when the nozzle surface is wiped with the strip-shaped member wetted with the wiping solution, there is a concern that liquid ejection from the nozzles becomes unstable after the wiping depending on the amount of liquid that has adhered to the nozzle surface.

SUMMARY

According to an aspect of a liquid ejecting apparatus that solves the aforementioned problem, the apparatus includes: a liquid ejecting portion configured to eject a liquid from a nozzle disposed in a nozzle surface; a wiping mechanism configured to execute a wiping operation of wiping the nozzle surface with a strip-shaped member, which is configured to absorb the liquid ejected by the liquid ejecting portion, in contact with the nozzle surface; a wiping solution supply mechanism configured to supply a wiping solution to the strip-shaped member before the wiping operation is performed; and a control portion, and the control portion reduces the amount of the wiping solution held in a contact region of the strip-shaped member that comes into contact with the nozzle surface in the wiping operation when the nozzle surface with a large amount of the liquid adhering thereto is wiped as compared with the amount of the wiping solution when the nozzle surface with a small amount of the liquid adhering thereto is wiped.

According to an aspect of a maintenance method for a liquid ejecting apparatus that solves the aforementioned problem, the liquid ejecting apparatus includes a liquid ejecting portion configured to eject a liquid from a nozzle disposed in a nozzle surface, a wiping mechanism configured to execute a wiping operation of wiping the nozzle surface with a strip-shaped member, which is configured to absorb the liquid ejected by the liquid ejecting portion, in contact with the nozzle surface, and a wiping solution supply mechanism configured to supply a wiping solution to the strip-shaped member before the wiping operation is performed, the method including: reducing the amount of the wiping solution held in a contact region of the strip-shaped member that comes into contact with the nozzle surface in the wiping operation when the nozzle surface with a large amount of the liquid adhering thereto is wiped as compared with the amount of the wiping solution when the nozzle surface with a small amount of the liquid adhering thereto is wiped.

DESCRIPTION OF EXEMPLARY EMBODIMENTS

Figure 1:
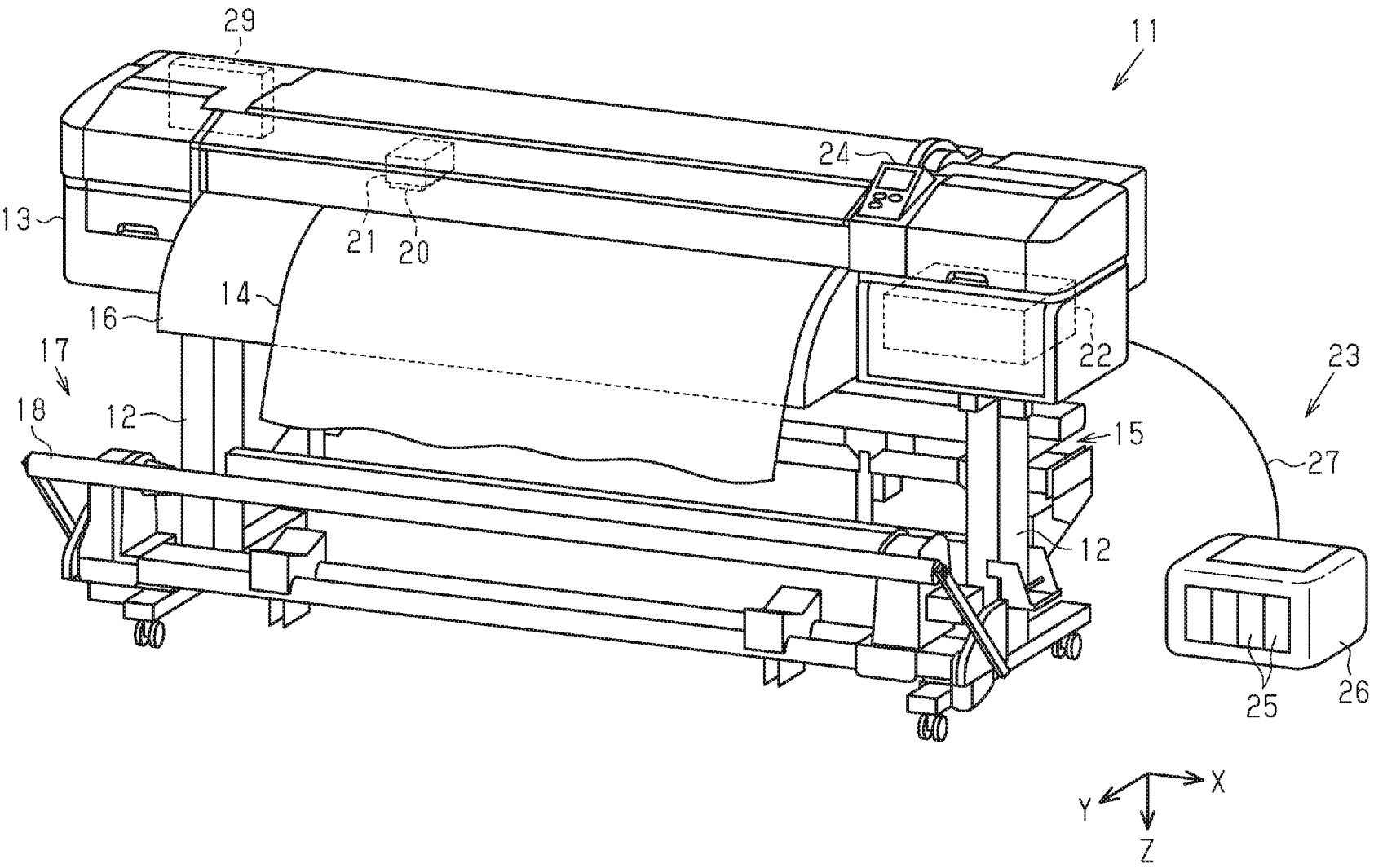
FIG. 1 is a perspective view of a liquid ejecting apparatus according to an embodiment.

Hereinafter, an embodiment of a liquid ejecting apparatus and a maintenance method for a liquid ejecting apparatus will be described with reference to drawings. The liquid ejecting apparatus is, for example, an ink jet printer configured to perform printing by ejecting ink, which is an example of a liquid, onto a medium such as paper.

In the drawings, a direction of gravity is represented by a Z axis, and directions that follow a horizontal surface are represented by an X axis and a Y axis on the assumption that the liquid ejecting apparatus 11 is placed on the horizontal surface. The X axis, the Y axis, and the Z axis perpendicularly intersect each other. In the following description, the direction along the X axis will also be referred to as a width direction X, the direction along the Y axis will also be referred to as a depth direction Y, and the direction along the Z axis will also be referred to as a gravity direction Z.

As shown in FIG. 1, the liquid ejecting apparatus 11 may include a pair of legs 12 and a housing 13 assembled on the legs 12. The liquid ejecting apparatus 11 may include a feeding portion 15 that unwinds and feeds a medium 14 wound and overlapped in a roll shape, a guide portion 16 that guides the medium 14 discharged from the housing 13, and a collecting portion 17 that winds and collects the medium 14. The liquid ejecting apparatus 11 may include a tension applying mechanism 18 that applies a tension to the medium 14 collected by the collecting portion 17.

The liquid ejecting apparatus 11 includes a liquid ejecting portion 20 capable of ejecting a liquid, a carriage 21 that causes the liquid ejecting portion 20 to move, and a maintenance unit 22 that performs maintenance of the liquid ejecting portion 20. The liquid ejecting apparatus 11 may include a liquid supply device 23 that supplies a liquid to the liquid ejecting portion 20 and an operation panel 24 operated by a user. The carriage 21 reciprocates the liquid ejecting portion 20 along the X axis. The liquid ejecting portion 20 ejects the liquid supplied through the liquid supply device 23 while moving, and performs printing on the medium 14.

The liquid supply device 23 includes an attachment portion 26 to which a plurality of liquid accommodating element 25 accommodating a liquid are detachably attached and a supply flow path 27 through which the liquid is supplied from the liquid accommodating element 25 attached to the attachment portion 26 to the liquid ejecting portion 20.

The liquid ejecting apparatus 11 includes a control portion 29 configured to control operations of the liquid ejecting apparatus 11. The control portion 29 includes, for example, a CPU, a memory, and the like. The control portion 29 controls the liquid ejecting portion 20, the liquid supply device 23, the maintenance unit 22, and the like by the CPU executing the program stored in the memory.

Figure 2:
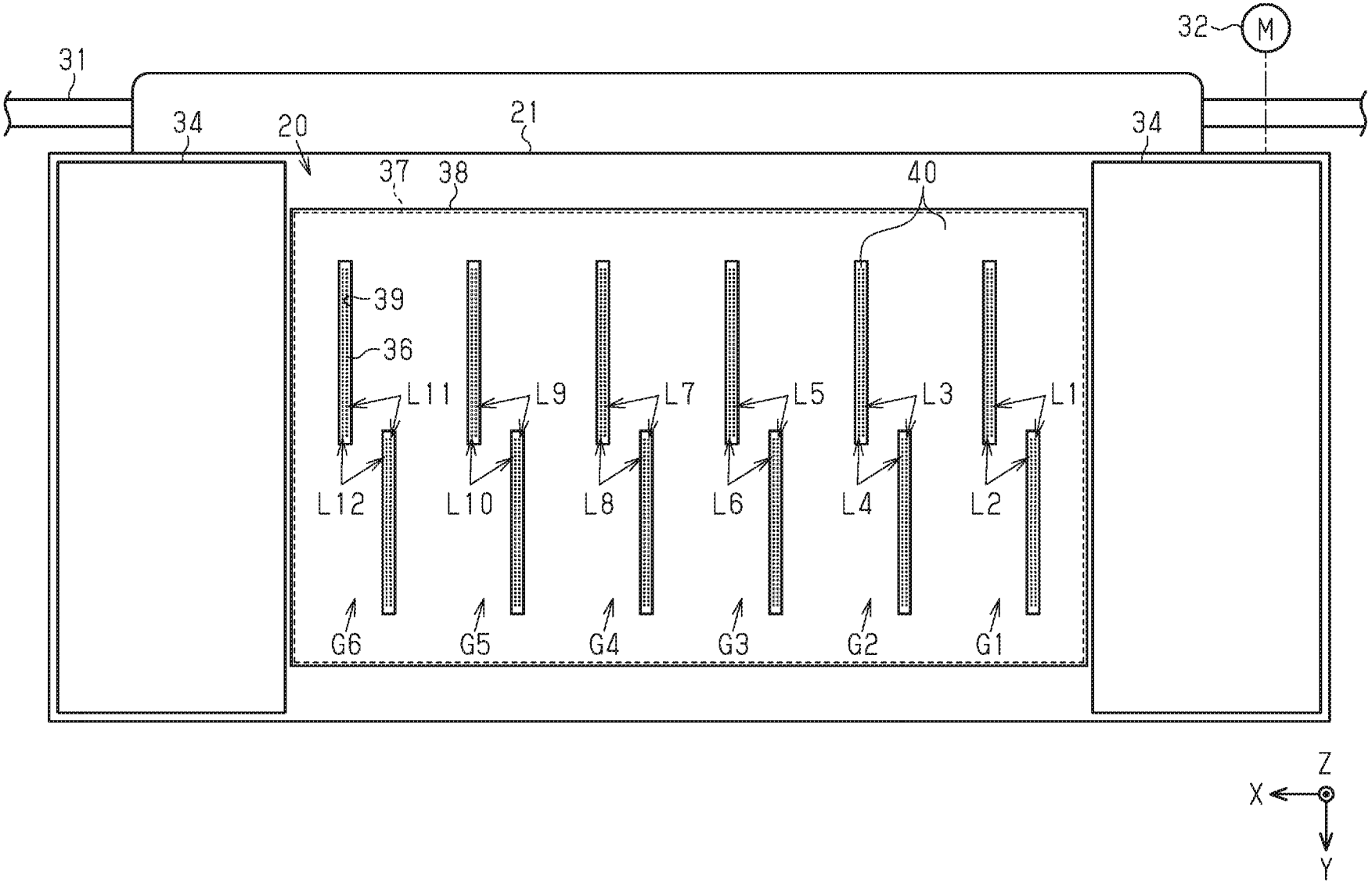
FIG. 2 is a schematic bottom view illustrating a liquid ejecting portion and a carriage.

As illustrated in FIG. 2, the liquid ejecting apparatus 11 may include a guide shaft 31 for supporting the carriage 21 and a carriage motor 32 for moving the carriage 21. The guide shaft 31 extends in the width direction X. The control portion 29 causes the carriage 21 and the liquid ejecting portion 20 to reciprocate along the guide shaft 31 by controlling the drive of the carriage motor 32.

The liquid ejecting apparatus 11 may include a rectification portion 34 held below the carriage 21. When rectification portions 34 are provided on both sides of the liquid ejecting portion 20 in the width direction X, it is possible to facilitate an air flow in the surroundings of the liquid ejecting portion 20 that reciprocates along the X axis.

The liquid ejecting portion 20 may include a nozzle forming member 37 in which a plurality of nozzles 36 are formed and a cover member 38 that covers a part of the nozzle forming member 37. The cover member 38 is configured of metal such as stainless steel, for example. A plurality of through-holes 39 penetrating through the cover member 38 in the gravity direction Z are formed in the cover member 38. The cover member 38 covers a side of the nozzle forming member 37 on which the nozzles 36 are formed such that the nozzles 36 are exposed from the through-holes 39. The nozzle surface 40 is formed to include the nozzle forming member 37 and the cover member 38. Specifically, the nozzle surface 40 is configured of the nozzle forming member 37 exposed from the through-holes 39 and the cover member 38. The liquid ejecting portion 20 can eject a liquid from the nozzles 36 disposed in the nozzle surface 40.

Multiple openings of the nozzles 36 configured to eject a liquid are aligned at constant intervals in one direction in the liquid ejecting portion 20. The plurality of nozzles 36 configure nozzle arrays. In the present embodiment, the openings of the nozzles 36 are aligned in the depth direction Y and configure first nozzle arrays L1 to twelfth nozzle arrays L12. Nozzles 36 configuring one nozzle array eject the same type of liquid. A nozzle 36 positioned on the furthest side in the depth direction Y and a nozzle 36 positioned on the front side in the depth direction Y among the nozzles 36 configuring one nozzle array are formed with positional deviations in the width direction X.

The first nozzle array L1 to the twelfth nozzle array L12 are aligned such that each two arrays are located closer in the width direction X. In the present embodiment, two nozzle arrays aligned closer to each other will be referred to as a nozzle group. A first nozzle group G1 to a sixth nozzle group G6 are disposed at constant intervals in the width direction X in the liquid ejecting portion 20.

Specifically, the first nozzle group G1 includes a first nozzle array L1 for ejecting magenta ink and a second nozzle array L2 for ejecting yellow ink. The second nozzle group G2 includes a third nozzle array L3 for ejecting cyan ink and a fourth nozzle array L4 for ejecting black ink. The third nozzle group G3 includes a fifth nozzle array L5 for ejecting light cyan ink and a sixth nozzle array L6 for ejecting light magenta ink. The fourth nozzle group G4 includes a seventh nozzle array L7 and an eighth nozzle array L8 for ejecting a processing solution. The fifth nozzle group G5 includes a ninth nozzle array L9 for ejecting black ink and a tenth nozzle array L10 for ejecting cyan ink. The sixth nozzle group G6 includes an eleventh nozzle array L11 for ejecting yellow ink and a twelfth nozzle array L12 for ejecting magenta ink.

Next, the maintenance unit 22 will be described.

Figure 3:
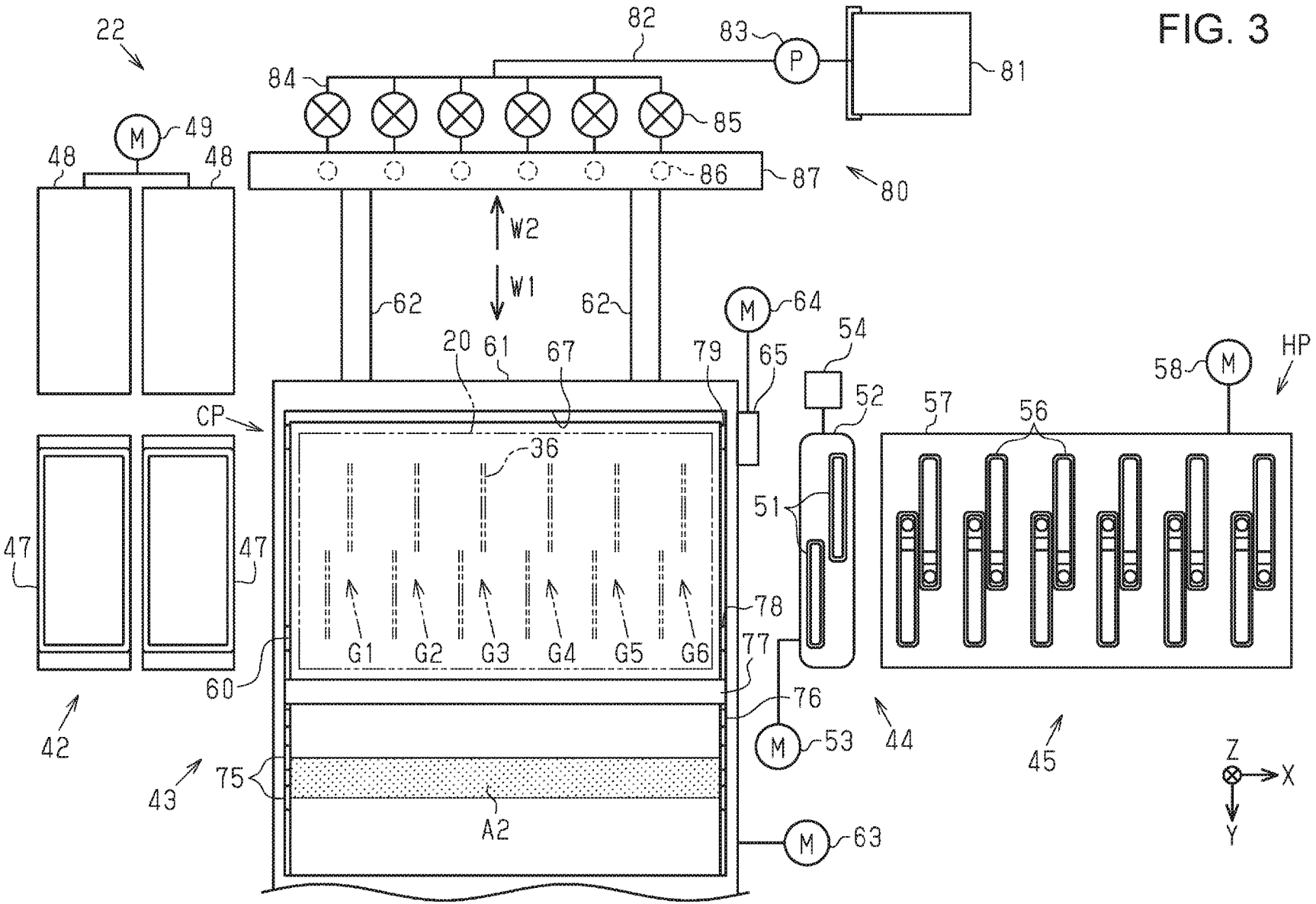
FIG. 3 is a schematic plan view of a maintenance unit.

As illustrated in FIG. 3, the maintenance unit 22 has a flushing device 42, a wiping mechanism 43, a suctioning device 44, and a capping device 45 aligned in the width direction X. Further, the maintenance unit 22 has a wiping solution supply mechanism 80 capable of supplying a wiping solution W illustrated in FIG. 5 to the wiping mechanism 43. The upper part of the capping device 45 serves as a home position HP of the liquid ejecting portion 20. The home position HP is a start point of movement of the liquid ejecting portion 20. The upper part of the wiping mechanism 43 serves as a cleaning position CP of the liquid ejecting portion 20. In FIG. 3, the liquid ejecting portion 20 positioned at the cleaning position CP is illustrated by a two-dotted dashed line.

The flushing device 42 receives the liquid ejected by the liquid ejecting portion 20 through flushing. Flushing means maintenance of ejecting the liquid as a waste solution for the purpose of preventing and solving clogging of the nozzles 36.

The flushing device 42 includes a liquid receiving portion 47 that receives the liquid ejected by the liquid ejecting portion 20 for flushing, a lid member 48 for covering an opening of the liquid receiving portion 47, and a lid motor 49 for moving the lid member 48. The flushing device 42 may include a plurality of liquid receiving portions 47 and a plurality of lid members 48. The control portion 29 may select a liquid receiving portion 47 depending on a type of liquid. The flushing device 42 in the present embodiment includes two liquid receiving portions 47, and one of the liquid receiving portions 47 receives a plurality of color inks ejected by the liquid ejecting portion 20 through flushing while the other one of the liquid receiving portions 47 receives a processing solution ejected by the liquid ejecting portion 20 through flushing. The liquid receiving portion 47 may accommodate a moisturizer.

The lid member 48 moves between a covering position, at which the lid member 48 covers the opening of the liquid receiving portion 47, which is not illustrated, and an exposure position, at which the lid member 48 causes the opening of the liquid receiving portion 47 to be exposed, which is illustrated in FIG. 3, through driving of the lid motor 49. When the flushing is not performed, the lid member 48 moves to the covering position to curb drying of the accommodated moisturizer and the received liquid.

The suctioning device 44 includes suctioning caps 51, a holding element for the suctioning 52 that holds the suctioning cap 51, a suctioning motor 53 that reciprocates the holding element for the suctioning 52 along the Z axis, and a pressure reducing mechanism 54 that reduces the pressure in the suctioning cap 51. The suctioning caps 51 move between a contact position and an evacuation position with movement of the holding element for the suctioning 52 caused by the suctioning motor 53. The contact position is a position at which the suctioning caps 51 come into contact with the liquid ejecting portion 20 and surround the nozzles 36. The evacuation position is a position to which the suctioning caps 51 are separated from the liquid ejecting portion 20.

The suctioning caps 51 may be configured to collectively surround all the nozzles 36, may be configured to surround at least one nozzle group, or may be configured to surround some nozzles 36 of nozzles 36 configuring the nozzle groups. The suctioning device 44 in the present embodiment surrounds one nozzle group from among the first nozzle group G1 to the sixth nozzle group G6 with the two suctioning caps 51.

The liquid ejecting apparatus 11 may cause the liquid ejecting portion 20 to be positioned above the suctioning device 44, cause the suctioning cap 51 to be positioned at the contact position to surround one nozzle group, and perform suctioning cleaning of reducing the pressure inside the suctioning caps 51 and causes the nozzles 36 to discharge the liquid. In other words, the suctioning device 44 may receive the liquid discharged through the suctioning cleaning.

The capping device 45 has a leaving cap 56, a holding element for the leaving 57 that holds the leaving cap 56, and a leaving motor 58 that reciprocates the holding element for the leaving 57 along the Z axis. The leaving cap 56 moves upward or downward with movement of the holding element for the leaving 57 caused by the leaving motor 58. The leaving cap 56 moves to the capping position, which is an upper position, from a separate position, which is a lower position, and comes into contact with the liquid ejecting portion 20 stopping at the home position HP.

The leaving cap 56 positioned at the capping position surrounds the openings of the nozzles 36 configuring the first nozzle group G1 to the sixth nozzle group G6. In this manner, maintenance in which the leaving cap 56 surrounds the openings of the nozzles 36 will be referred to as leaving capping. The leaving capping is a type of capping. The leaving capping curbs drying of the nozzles 36.

The leaving cap 56 may be configured to collectively surround all the nozzles 36, may be configured to surround at least one nozzle group, or may be configured to surround some nozzles 36 among the nozzles 36 configuring the nozzle groups.

Next, the wiping mechanism 43 will be described.

The wiping mechanism 43 includes a strip-shaped member 60 capable of absorbing the liquid ejected by the liquid ejecting portion 20. The wiping mechanism 43 may include a case 61 that accommodates the strip-shaped member 60, a pair of rails 62 that extend along the Y axis, a wiping-off motor 63, a winding motor 64, and a power transmission mechanism 65 that transmits power from the winding motor 64. The case 61 has an opening 67 from which the strip-shaped member 60 is exposed. The size of the strip-shaped member 60 in the width direction X may be equal to or greater than the size of the nozzle surface 40. In this case, it is possible to efficiently perform maintenance of the liquid ejecting portion 20.

The case 61 reciprocates on the rails 62 along the Y axis using power from the wiping-off motor 63. Specifically, the case 61 moves between the standby position illustrated in FIG. 4 and the receiving position illustrated in FIG. 3. When the wiping-off motor 63 is driven forward, then the case 61 positioned at the standby position moves in a first wiping-off direction W1 that is parallel to the Y axis toward the receiving position. When the wiping-off motor 63 is driven backward, the case 61 positioned at the receiving position moves in a second wiping-off direction W2 that is opposite to the first wiping-off direction W1 toward the standby position.

The wiping mechanism 43 can execute a wiping operation of causing the strip-shaped member 60 to come into contact with the nozzle surface 40 and wiping the nozzle surface 40. The wiping mechanism 43 performs the wiping operation in the process in which the case 61 moves between the standby position and the receiving position. The control portion 29 may cause the wiping mechanism to successively perform the wiping operation a plurality of times. For example, the wiping mechanism 43 may perform the first wiping operation in a process in which the case 61 positioned at the receiving position moves in the second wiping-off direction W2 and may perform the second wiping operation in a process in which the case 61 moves in the first wiping-off direction W1.

Figure 4:
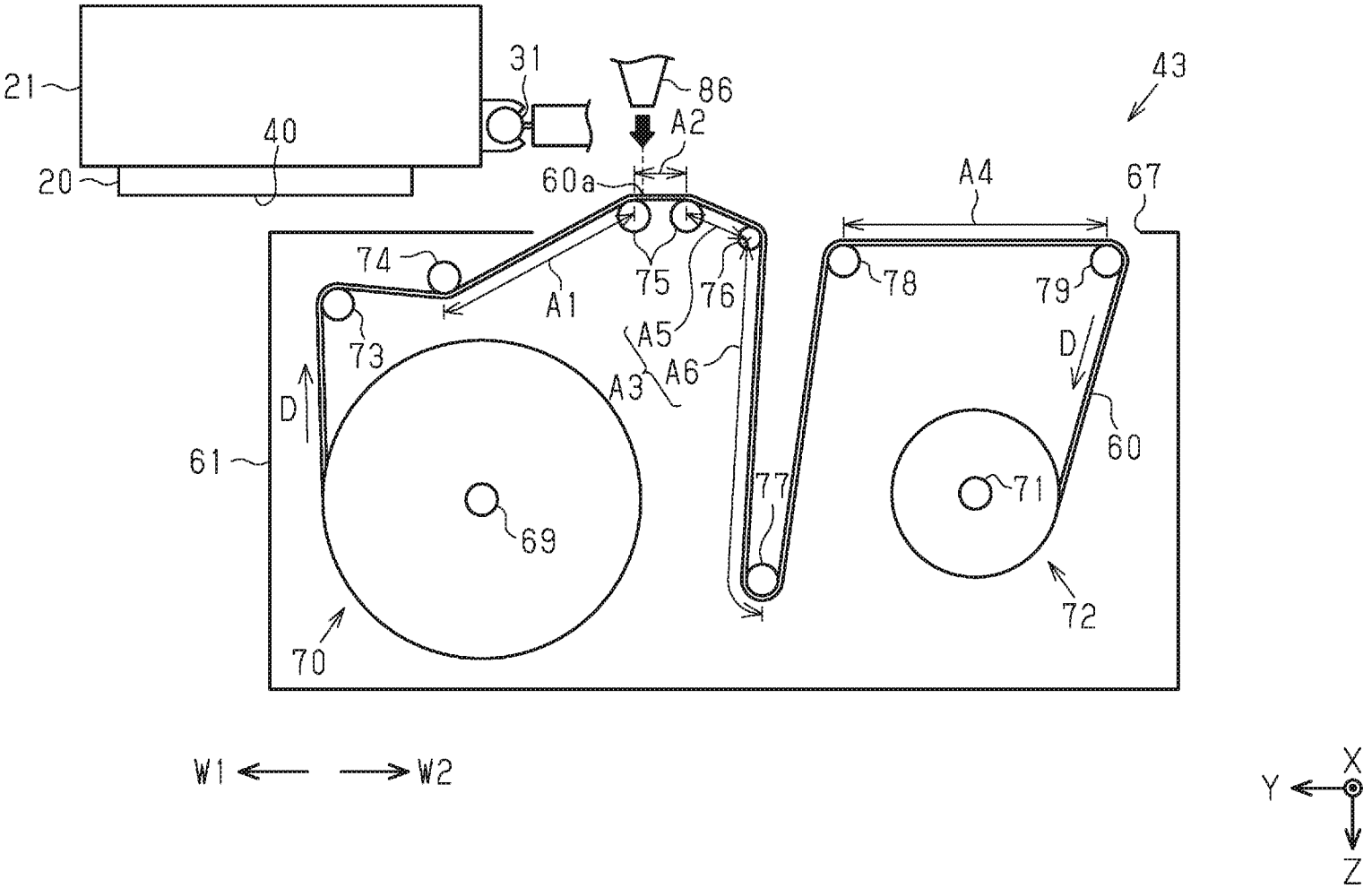
FIG. 4 is a schematic side view of a wiping mechanism with a case positioned at a standby position.

As illustrated in FIG. 4, the wiping mechanism 43 includes an unwinding portion 70 that has an unwinding shaft 69 and a winding portion 72 that has a winding shaft 71. The case 61 rotatably supports the unwinding shaft 69 and the winding shaft 71 with the X axis defined as an axial direction. The unwinding portion 70 holds the strip-shaped member 60 in a state in which the strip-shaped member 60 is wound in a roll shape. The strip-shaped member 60 unwound and fed from the unwinding portion 70 is transported to the winding portion 72 along a transport path.

The wiping mechanism 43 may include an upstream roller 73, a tension roller 74, two pressing rollers 75, a downstream roller 76, a regulation roller 77, a first horizontal roller 78, and a second horizontal roller 79 provided in order from upstream along the transport path of the strip-shaped member 60. The case 61 rotatably supports the aforementioned various rollers with the X axis in the axial direction.

The winding shaft 71 is driven to rotate by the winding motor 64. The winding portion 72 winds the strip-shaped member 60 around the winding shaft 71 in a roll shape. The winding portion 72 causes the portion of the strip-shaped member 60 unwound from the unwinding portion 70 to move in a moving direction D by winding the strip-shaped member 60. The moving direction D is a direction along the transport path of the strip-shaped member 60 and is a direction from the unwinding portion 70 disposed on upstream toward the winding portion 72 disposed on downstream.

The power transmission mechanism 65 may couple the winding motor 64 and the winding shaft 71 when the case 61 is positioned at the standby position and may separate the winding motor 64 from the winding shaft 71 when the case 61 is separated from the standby position. The winding motor 64 may drive and rotate at least one of the unwinding shaft 69, the upstream roller 73, the tension roller 74, the two pressing rollers 75, the downstream roller 76, the regulation roller 77, the first horizontal roller 78, and the second horizontal roller 79 along with the winding shaft 71.

In the present embodiment, the two pressing rollers 75 are provided to be aligned in the depth direction Y. The two pressing rollers 75 press the strip-shaped member 60 unwound from the unwinding portion 70 from the lower side to the upper side and cause the strip-shaped member 60 to project from the opening 67.

An upstream region A1, a contact region A2 capable of coming into contact with the nozzle surface 40, a downstream region A3, and a horizontal region A4 that is substantially horizontally held are positioned in the strip-shaped member 60 in order from the upstream in the moving direction D.

The contact region A2 is a region between positions with which the uppermost portions of the two pressing rollers 75 come into contact. In the contact region A2, the strip-shaped member 60 is substantially horizontally held. The contact region A2 comes into contact with the nozzle surface 40 in the wiping operation. In the drawing, the contact region A2 is illustrated by dot hatching.

The upstream region A1 is provided upstream the contact region A2 in the moving direction D to be continuous with the contact region A2. The downstream region A3 is provided downstream the contact region A2 in the moving direction D to be continuous with the contact region A2. In the upstream region A1 and the downstream region A3, the strip-shaped member 60 is held in a state in which the strip-shaped member 60 is inclined with respect to a horizontal surface. The downstream region A3 may include a mild inclined region A5 with a mild inclination and a steep inclined region A6 with a steep inclination. In this case, an angle formed between the nozzle surface 40 and the upstream region A1 and an angle formed between the nozzle surface 40 and the mild inclined region A5 when the contact region A2 comes into contact with the nozzle surface 40 may be set to be equal to or greater than 3 degrees and equal to or less than 30 degrees.

The horizontal region A4 is a region from the position of the strip-shaped member 60 with which the uppermost portion of the first horizontal roller 78 comes into contact to the position thereof with which the uppermost portion of the second horizontal roller 79 comes into contact. The horizontal region A4 faces the nozzle surface 40 when the case 61 is positioned at the receiving position and the liquid ejecting portion 20 is positioned at the cleaning position CP. The liquid ejecting apparatus 11 may perform pressure-cleaning of causing the nozzles 36 to discharge a pressurized liquid in this state. In other words, the wiping mechanism 43 may receive the liquid discharged through the pressure-cleaning.

Next, the wiping solution supply mechanism 80 will be described.

As illustrated in FIG. 3, the wiping solution supply mechanism 80 includes a storage portion 81 that stores the wiping solution W, a wiping solution supply flow path 82 to which the wiping solution W is supplied from the storage portion 81, a supply pump 83 disposed in the wiping solution supply flow path 82, a plurality of branched flow paths 84 branched from the wiping solution supply flow path 82, and opening/closing valves 85 disposed in the branched flow paths 84. The opening/closing valves 85 bring the branched flow paths 84 into a closed state by closing the valves and bring the branched flow paths 84 into a distributing state by opening the valves.

The wiping solution supply mechanism 80 includes supply nozzles 86 capable of ejecting the wiping solution W flowing through the branched flow paths 84 onto the strip-shaped member 60 and a holding element for the supplying 87 that holds the supply nozzles 86. The holding element for the supplying 87 holds the supply nozzles 86 at positions at which the supply nozzles 86 face the strip-shaped member 60 when the case 61 is at the standby position.

As illustrated in FIG. 4, the supply nozzles 86 in the present embodiment are positioned above the strip-shaped member 60, drop the wiping solution W from the upper side, and supply the wiping solution W to the strip-shaped member 60. The strip-shaped member 60 in the present embodiment is adapted such that a catching portion 60*a* in the contact region A2 receives the wiping solution W.

As the wiping solution W, pure water may be employed, or a liquid obtained by containing a preservative in pure water may be employed. As the wiping solution W, a liquid with higher surface tension than surface tension of the liquid used by the liquid ejecting portion 20 may be employed. For example, a liquid with surface tension of equal to or greater than 40 mN/m and equal to or less than 80 mN/m may be employed, or a liquid with surface tension of equal to or greater than 60 mN/m and equal to or less than 80 mN/m may be employed as the wiping solution W.

As illustrated in FIG. 3, the wiping solution supply mechanism 80 may include a plurality of branched flow paths 84, a plurality of opening/closing valves 85, and a plurality of supply nozzles 86. The wiping solution supply mechanism 80 may have six branched flow paths 84, six opening/closing valves 85, and six supply nozzles 86 such that the numbers thereof are the same number of the nozzle groups included in the liquid ejecting portion 20. In other words, the wiping solution supply mechanism 80 may include six supply nozzles 86 aligned in the width direction X so as to individually correspond to the first nozzle group G1 to the sixth nozzle group G6. The wiping mechanism 43 may wipe off the surroundings of each nozzle group with a portion of the contact region A2, which faces each supply nozzle 86, to which the wiping solution W is supplied.

The control portion 29 may individually open or close the plurality of opening/closing valves 85. In the present embodiment, a state in which some of the opening/closing valves 85 are opened such that the wiping solution W is supplied from the opened opening/closing valves 85 will be defined as a first supply state while a state in which all the opening/closing valves 85 are opened such that the wiping solution W is supplied from all the supply nozzles 86 will be defined as a second supply state.

In the first supply state, the wiping solution W may be supplied from the supply nozzles 86 corresponding to a nozzle group for ejecting a liquid containing an inorganic pigment. When the black ink contains the inorganic pigment and the other ink contains an organic pigment, for example, the fourth nozzle array L4 and the ninth nozzle array L9 for ejecting the black ink corresponds to the nozzle arrays for ejecting the ink containing the inorganic pigment in the present embodiment. In other words, the second nozzle group G2 including the fourth nozzle array L4 and the fifth nozzle group G5 including the ninth nozzle array L9 are nozzle groups including the nozzles 36 for ejecting the ink containing the inorganic pigment. Thus, the control portion 29 may open the opening/closing valves 85 such that the wiping solution W is supplied from the supply nozzles 86 corresponding to the second nozzle group G2 and the fifth nozzle group G5. In this manner, it is possible to supply the wiping solution W to the portion that wipes off the surroundings of the second nozzle group G2 and the fifth nozzle group G5 to which the black ink is likely to adhere, and the inorganic pigment is likely to be taken into the strip-shaped member 60.

Effects of the present embodiment will be described.

The wiping solution supply mechanism 80 can supply the wiping solution W to the strip-shaped member 60 before the wiping operation is performed. When the nozzle surface 40 with a large amount of liquid adhering thereto is wiped, the control portion 29 reduces the amount of wiping solution W held in the contact region A2 as compared with that when the nozzle surface 40 with a small amount of liquid adhering thereto is wiped.

The liquid adhering to the nozzle surface 40 is reduced through the wiping operation. When the wiping operation is successively performed twice, the nozzle surface 40 with a large amount of liquid adhering thereto is wiped off in the first wiping operation, and the nozzle surface 40 with a small amount of liquid adhering thereto is wiped off in the second wiping operation. When the wiping operation is successively performed twice, the control portion 29 may reduce the amount of wiping solution W held in the contact region A2 in the wiping operation first as compared with the amount of wiping solution W held in the contact region A2 in the wiping operation performed next.

The control portion 29 may reduce the amount of wiping solution W held in the contact region A2 by reducing the amount of wiping solution W to be supplied to the strip-shaped member 60 before the wiping operation is performed. The control portion 29 may adjust the amount of wiping solution W that the wiping solution supply mechanism 80 is to supply to the strip-shaped member 60 with the number of opening/closing valves 85 to be opened. The wiping solution supply mechanism 80 in the first supply state supplies the wiping solution W from some of the supply nozzles 86 while the wiping solution supply mechanism 80 in the second supply state supplies the wiping solution W from all the supply nozzles 86. Therefore, the amount of wiping solution W supplied in the first supply state is smaller than the amount of wiping solution W supplied in the second supply state. The amount of wiping solution W held in the contact region A2 when the wiping solution W is supplied in the first supply state is smaller than the amount of wiping solution W held in the contact region A2 when the wiping solution W is supplied in the second supply state.

The control portion 29 may reduce the amount of wiping solution W held in the contact region A2 by extending a time interval from when the wiping solution W is supplied to the strip-shaped member 60 to when the wiping operation is performed. The wiping solution W supplied to the catching portion 60*a* spreads with elapse of time. A range in which the wiping solution W spreads is not limited to the contact region A2, and the wiping solution W spreads to the outside of the contact region A2. Therefore, the amount of the wiping solution W held in the upstream region A1 and the downstream region A3 increases with elapse of time while the amount of the wiping solution W held in the contact region A2 decreases.

Figure 5:
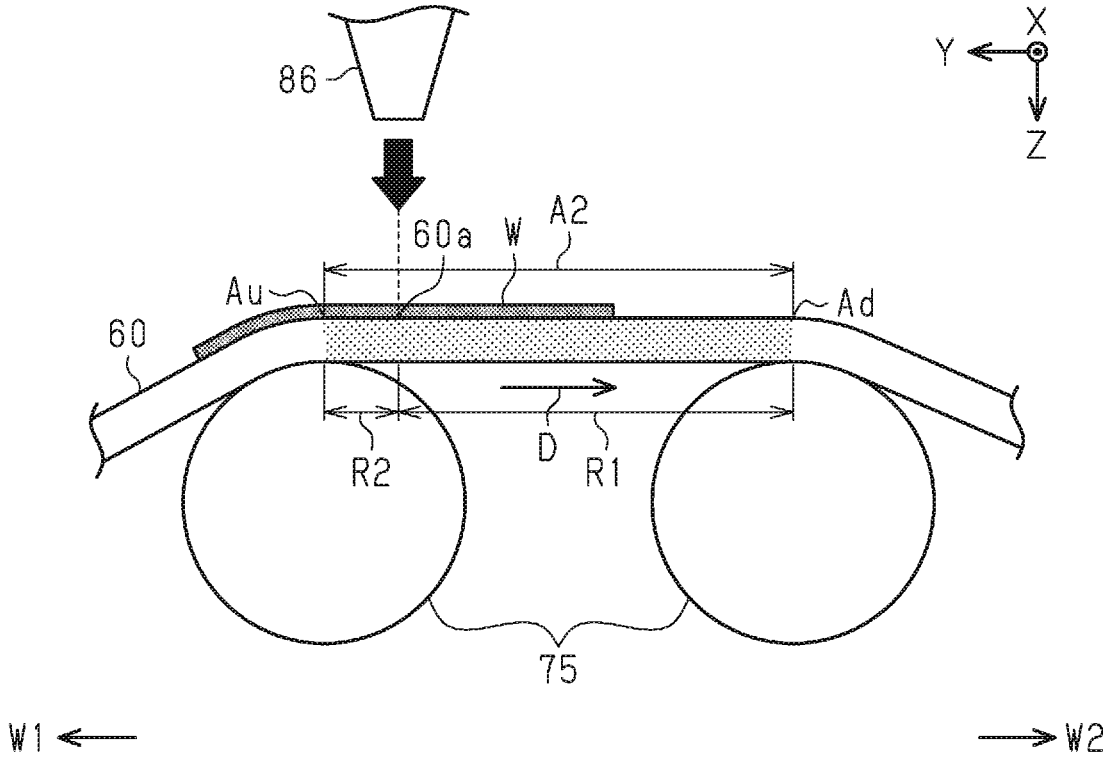
FIG. 5 is a schematic view for explaining supply of a wiping solution to a strip-shaped member.

As illustrated in FIG. 5, the portion of the contact region A2 that comes into contact with the nozzle surface 40 first in the wiping operation will be defined as a front-side contact portion. The front-side contact portion changes depending on a direction in which the nozzle surface 40 is wiped off. When the wiping operation is performed with the case 61 moving in the first wiping-off direction W1, an upstream end Au of the contact region A2 serves as the front-side contact portion. When the wiping operation is performed with the case 61 moving in the second wiping-off direction W2, a downstream end Ad of the contact region A2 serves as the front-side contact portion. The control portion 29 may reduce the amount of wiping solution W held in the front-side contact portion by extending the distance between the catching portion 60*a* of the strip-shaped member 60 that receives the wiping solution W supplied before the wiping operation is performed and the front-side contact portion.

The catching portion 60*a* is positioned at a position with a deviation from the center of the contact region A2 in the first wiping-off direction W1. In other words, the catching portion 60*a* is positioned between the center of the contact region A2 and the upstream end Au of the contact region A2. Therefore, a first distance R1 between the catching portion 60*a* and the downstream end Ad of the contact region A2 is longer than a second distance R2 from the catching portion 60*a* to the upstream end Au, Next, a case in which the control portion 29 performs pressure-cleaning, a first wiping operation, a second wiping operation, and flushing in order as maintenance for the liquid ejecting apparatus 11 will be described.

As illustrated in FIG. 4, the control portion 29 causes the wiping solution supply mechanism 80 to supply the wiping solution W to the strip-shaped member 60 before the pressure-cleaning. In the present embodiment, the first wiping operation is performed after the pressure-cleaning. Therefore, the supply of the wiping solution W performed before the pressure-cleaning is also supply of the wiping solution W performed before the first wiping operation. When the supply of the wiping solution W is performed, the control portion 29 causes the case 61 to be positioned at the standby position. The control portion 29 causes some of the supply nozzles 86 to supply a first supply amount of wiping solution W to the contact region A2 by bringing the wiping solution supply mechanism 80 into the first supply state.

As illustrated in FIG. 5, the wiping solution W that has been supplied from the supply nozzles 86 to the catching portion 60*a* is absorbed by the strip-shaped member 60 and also spreads in the strip-shaped member 60. How the wiping solution W spreads from the catching portion 60*a* is illustrated in the drawing in an overlapping manner on the strip-shaped member 60.

When the supply of the wiping solution W to the contact region A2 is completed, then the control portion 29 drives the wiping-off motor 63 forward and causes the case 61 to move in the first wiping-off direction W1. The case 61 moves from the standby position illustrated in FIG. 4 to the receiving position illustrated in FIG. 6.

Figure 6:
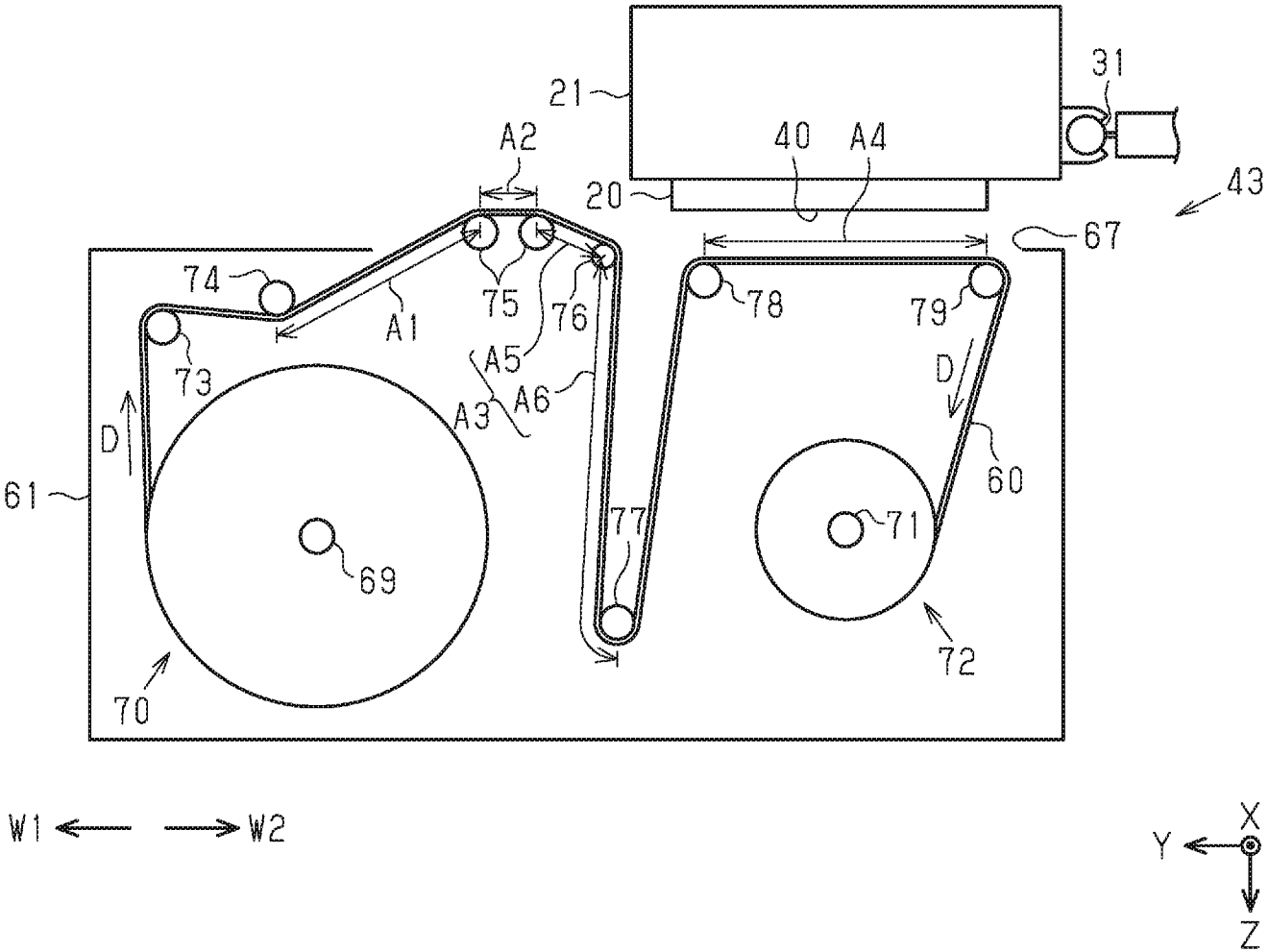
FIG. 6 is a schematic side view of the wiping mechanism with the case positioned at a receiving position.

As illustrated in FIGS. 3 and 6, when the case 61 reaches the receiving position, then the case 61 stops at the receiving position by the control portion 29 stopping the driving of the wiping-off motor 63. The control portion 29 causes the liquid ejecting portion 20 to move to and stop at the cleaning position CP in a state in which the case 61 is stopped at the receiving position.

The control portion 29 controls the liquid supply device 23, supplies a pressurized liquid to the nozzles 36, and causes the nozzles 36 to discharge the liquid, thereby performing the pressure-cleaning. The liquid discharged from the nozzles 36 stays so as to spread in and wet the nozzle surface 40. When the amount of the liquid staying in the nozzle surface 40 increases, then the liquid drops from the nozzle surface 40. At this time, the horizontal region A4 of the strip-shaped member 60 is positioned right below the nozzles 36. Therefore, the liquid discharged in the pressure-cleaning is received by the horizontal region A4.

Figure 7:
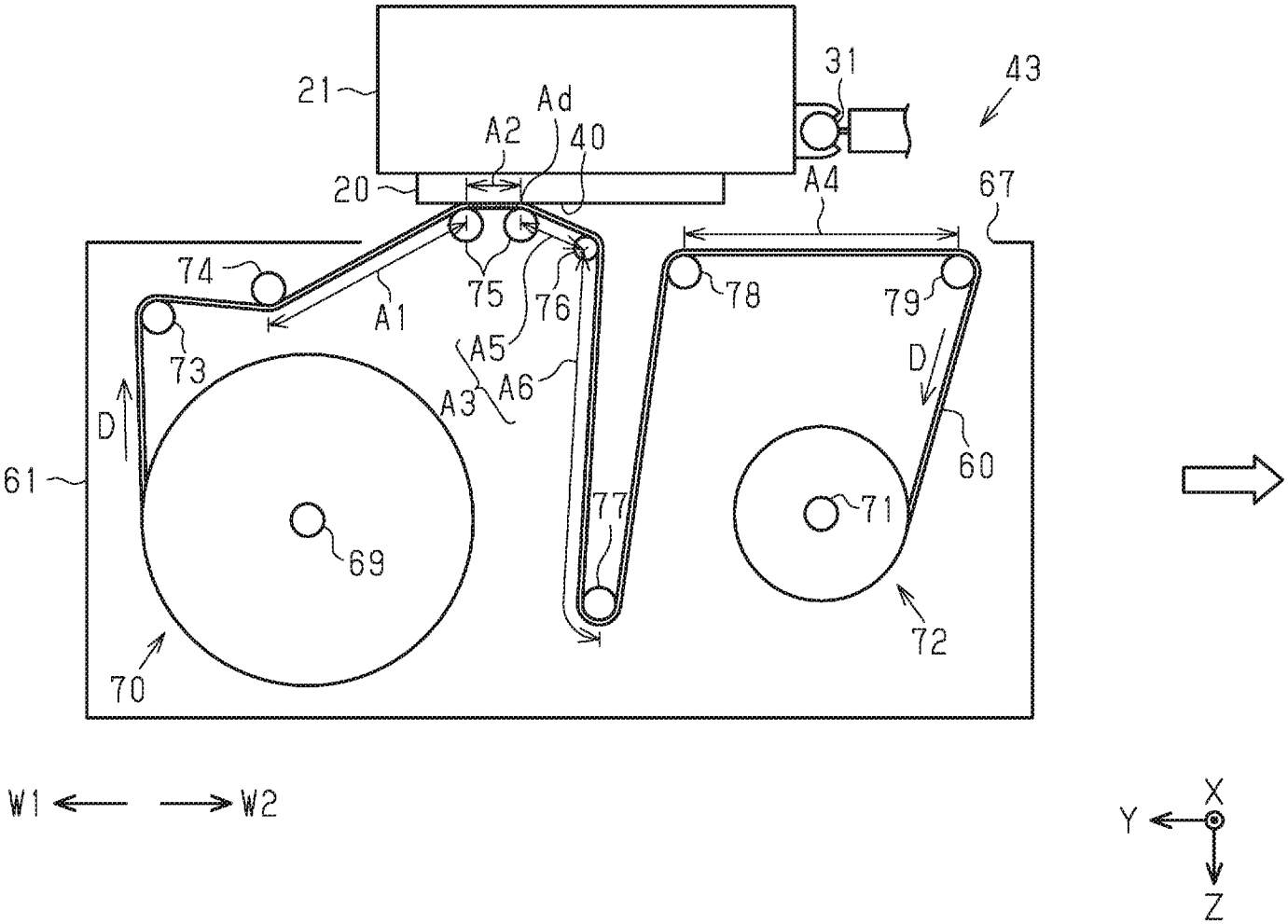
FIG. 7 is a schematic side view of the wiping mechanism that is performing a first wiping operation.

As illustrated in FIG. 7, the control portion 29 performs the first wiping operation after the pressure-cleaning is performed. The control portion 29 drives the wiping-off motor 63 backward with the liquid ejecting portion 20 positioned at the cleaning position CP and causes the case 61 to move in the second wiping-off direction W2. In this manner, the contact region A2 moves in the second wiping-off direction W2 in contact with the nozzle surface 40, and the nozzle surface 40 is wiped off by the contact region A2.

The wiping mechanism 43 is adapted such that the two pressing rollers 75 press the strip-shaped member 60 against the nozzle surface 40, and the case 61 moves in a state in which the strip-shaped member 60 is interposed between each pressing rollers 75 and the nozzle surface 40, thereby performing the wiping operation. In the first wiping operation, the liquid discharged from the liquid ejecting portion 20 in the pressure-cleaning and remaining in the nozzle surface 40 is wiped off with the strip-shaped member 60.

Here, a time interval from when the wiping solution W is supplied to the strip-shaped member 60 to when the first wiping operation is performed will be defined as a first time. The first time is a total time of a time required by the case 61 to move from the standby position to the receiving position, a time required for the pressure-cleaning, and a time required by the case 61 to move from the receiving position to a wiping operation starting position. The first wiping operation starting position is a position at which the downstream end Ad of the contact region A2 that is a front-side contact portion starts to come into contact with the nozzle surface 40.

When the contact region A2 is separated from the nozzle surface 40, then the first wiping operation is completed. The control portion 29 continues the backward driving of the wiping-off motor 63 even after the first wiping operation is completed and causes the case 61 to move to the standby position.

As illustrated in FIG. 4, the control portion 29 may drive the winding motor 64 until the wiping-off motor 63 is driven forward after the driving of the wiping-off motor 63 is stopped. In this manner, it is possible to wind the strip-shaped member 60 around the winding portion 72 until the case 61 is positioned at the standby position and to perform the first wiping operation and the second wiping operation with different portions of the strip-shaped member 60.

The control portion 29 may bring the wiping solution supply mechanism 80 into the second supply state in the state in which the case 61 is positioned at the standby position and cause the wiping solution W to be supplied to the strip-shaped member 60. In other words, the wiping solution supply mechanism 80 may supply the wiping solution W to the strip-shaped member 60 before the second wiping operation is performed. The wiping solution supply mechanism 80 in the second supply state supplies the second supply amount of wiping solution W from all the supply nozzles 86.

Figure 8:
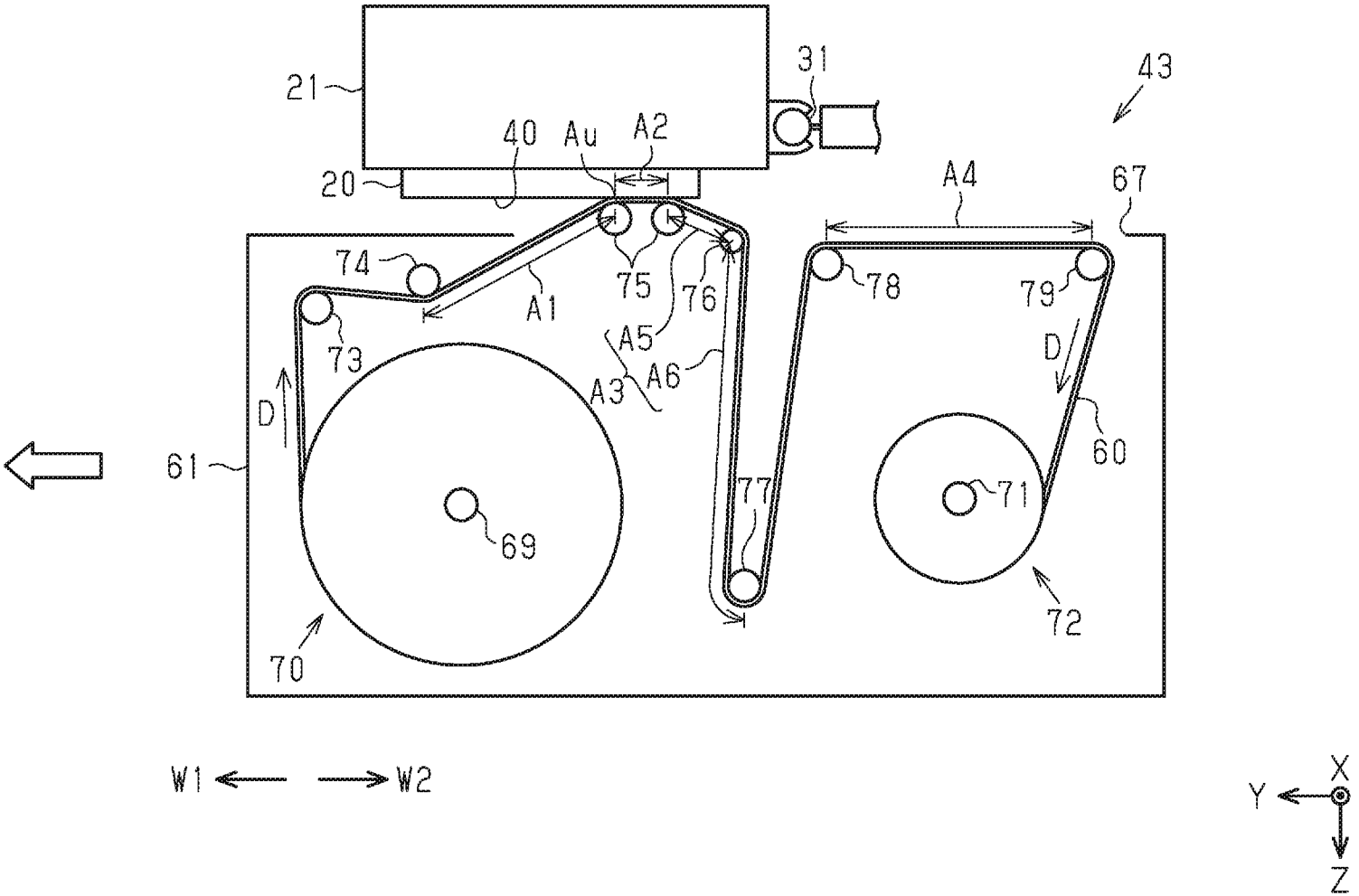
FIG. 8 is a schematic side view of the wiping mechanism that is performing a second wiping operation.

As illustrated in FIG. 8, when the supply of the wiping solution W to the strip-shaped member 60 is completed, then the control portion 29 drives the wiping-off motor 63 forward and causes the second wiping operation to be performed. The case 61 moves in the first wiping-off direction W1 from the standby position. The contact region A2 moves in the first wiping-off direction W1 in contact with the nozzle surface 40 and wipes off the nozzle surface 40.

Here, a time interval from when the wiping solution W is supplied for the second time to when the second wiping operation is performed will be defined as a second time. The second time is a time required to move from the standby position to the wiping operation starting position. The second wiping operation starting position is a position at which the upstream end Au of the contact region A2 that is the front-side contact portion starts to come into contact with the nozzle surface 40.

In the present embodiment, the first distance R1 between the downstream end Ad that serves as the front-side contact portion in the first wiping operation and the catching portion 60*a* is longer than the second distance R2 between the upstream end Au that serves as the front-side contact portion in the second wiping operation and the catching portion 60*a*. Therefore, even when the first supply amount is the same as the second supply amount and the first time is the same as the second time, the amount of the wiping solution W held at the downstream end Ad and the upstream end of the mild inclined region A5 forming an including angle with the nozzle surface 40 in the first wiping operation is smaller than the amount of wiping solution W held at the upstream end Au and the downstream end of the upstream region A1 forming an including angle with the nozzle surface 40 in the second wiping operation.

The first supply amount is smaller than the second supply amount. The first time is longer than the second time. Therefore, the amount of wiping solution W held in the contact region A2 in the first wiping operation is smaller than the amount of wiping solution W held in the contact region A2 in the second wiping operation.

When the contact region A2 is separated from the nozzle surface 40, then the second wiping operation is completed. The control portion 29 continues the forward driving of the wiping-off motor 63 even after the second wiping operation is completed and causes the case 61 to move to the receiving position.

When the second wiping operation is completed, then the control portion 29 causes the liquid ejecting portion 20 to move along the guide shaft 31 and causes the liquid ejecting portion 20 to perform the flushing at a timing at which the liquid ejecting portion 20 passes through the liquid receiving portion 47. The flushing is maintenance performed by causing the liquid ejecting portion 20 to eject the liquid. When the flushing is completed, then the control portion 29 causes the liquid ejecting portion 20 to move to the home position HP.

The control portion 29 drives the wiping-off motor 63 backward in a state in which the liquid ejecting portion 20 is positioned at the home position HP and causes the case 61 to move to the standby position. The control portion 29 may drive the winding motor 64 in the state in which the case 61 is positioned at the standby position and may wind the strip-shaped member 60.

Effects of the present embodiment will be described.

1. The control portion 29 adjusts the amount of wiping solution W to be held in the contact region A2 of the strip-shaped member 60 to correspond to the amount of liquid adhering to the nozzle surface 40. Therefore, it is possible to reduce the concern that the ejecting state in which the liquid is ejected from the nozzles 36 becomes unstable after the wiping operation.

2. The control portion 29 reduces the amount of wiping solution W held in the contact region A2 by reducing the amount of wiping solution W to be supplied to the strip-shaped member 60. In other words, it is possible to easily adjust the amount of wiping solution W to be held in the contact region A2 by adjusting the amount of wiping solution W to be supplied to the strip-shaped member 60.

3. The strip-shaped member 60 can absorb the liquid. Therefore, the wiping solution W supplied to the strip-shaped member 60 spreads to the surroundings thereof with elapse of time. The control portion 29 reduces the amount of wiping solution W to be held in the contact region A2 by extending the time interval from when the wiping solution W is supplied to the strip-shaped member 60 to when the wiping is performed. Therefore, it is possible to easily adjust the amount of wiping solution W to be held in the contact region A2.

4. The control portion 29 reduces the amount of wiping solution W to be held in the front-side contact portion by extending the distance between the catching portion 60*a* and the front-side contact portion. In the contact region A2, the front-side contact portion comes into contact with the nozzle surface 40 first in the wiping operation. Therefore, the liquid adhering to the nozzle surface 40 is likely to be collected at the front-side contact portion. When the amount of liquid adhering to the nozzle surface 40 is large, for example, it is possible to facilitate absorption of the liquid adhering to the nozzle surface 40 into the strip-shaped member 60 by reducing the amount of wiping solution W to be held in the front-side contact portion as compared with that when the amount of liquid adhering to the nozzle surface 40 is small.

5. The liquid adhering to the nozzle surface 40 is reduced through the wiping operation. Therefore, the amount of liquid adhering to the nozzle surface 40 before the first wiping operation is performed is larger than the amount of liquid adhering to the nozzle surface 40 before the next wiping operation is performed after the first wiping operation ends. The control portion 29 reduces the amount of wiping solution W to be held in the contact region A2 in the first wiping operation as compared with the amount of wiping solution W to be held in the contact region A2 in the next wiping operation. Therefore, it is possible to reduce the concern that the ejecting state in which the liquid is ejected from the nozzles 36 after the wiping operation becomes unstable even when the wiping operation is successively performed.

The present embodiment can also be performed with the following modifications. The present embodiment and the following modification examples can be performed in combination within a range in which technical conflicts do not occur.

Figure 9:
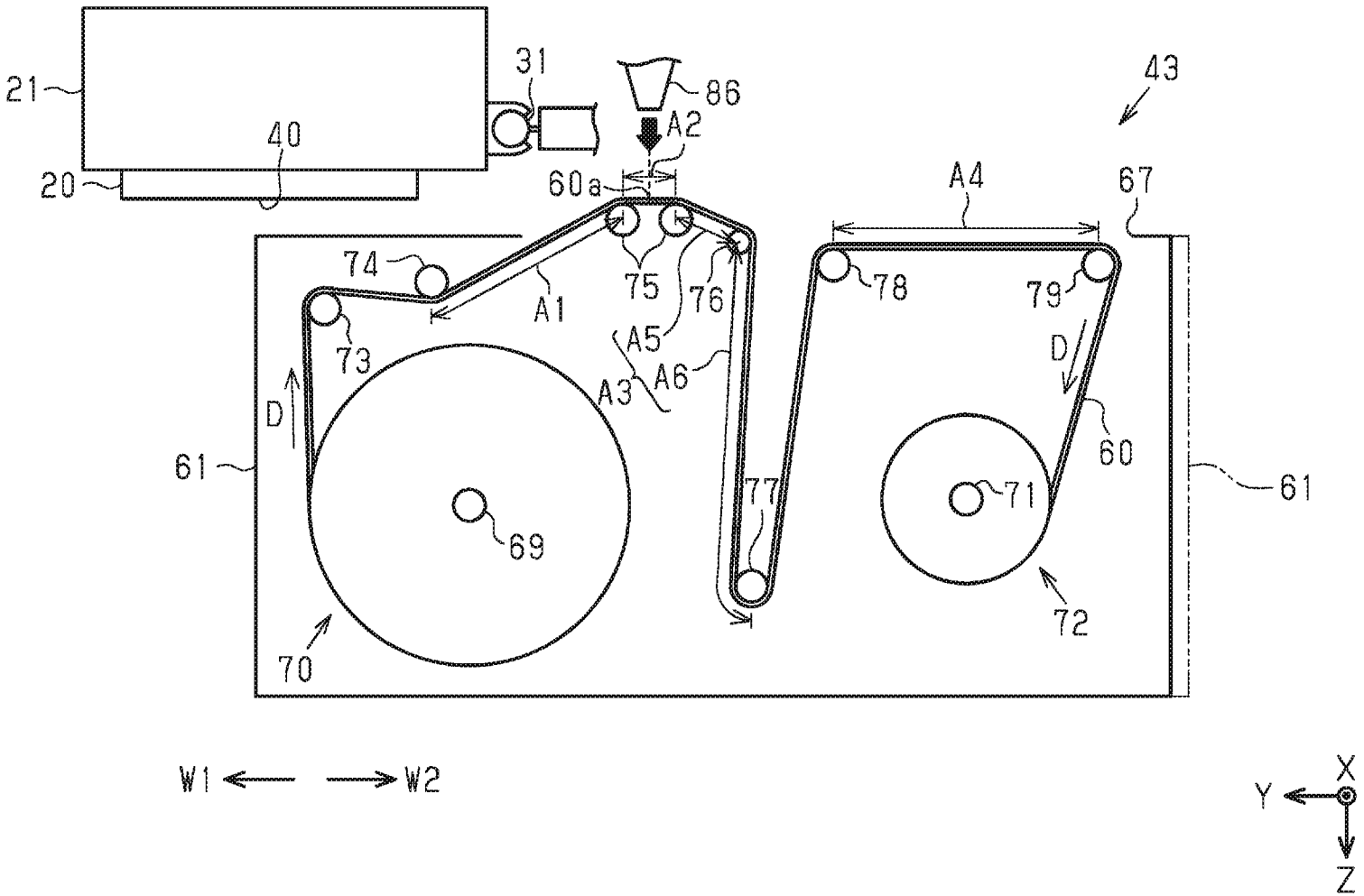
FIG. 9 is a schematic side view of a wiping mechanism with a case positioned at a refilling position according to a modification example.
Figure 10:
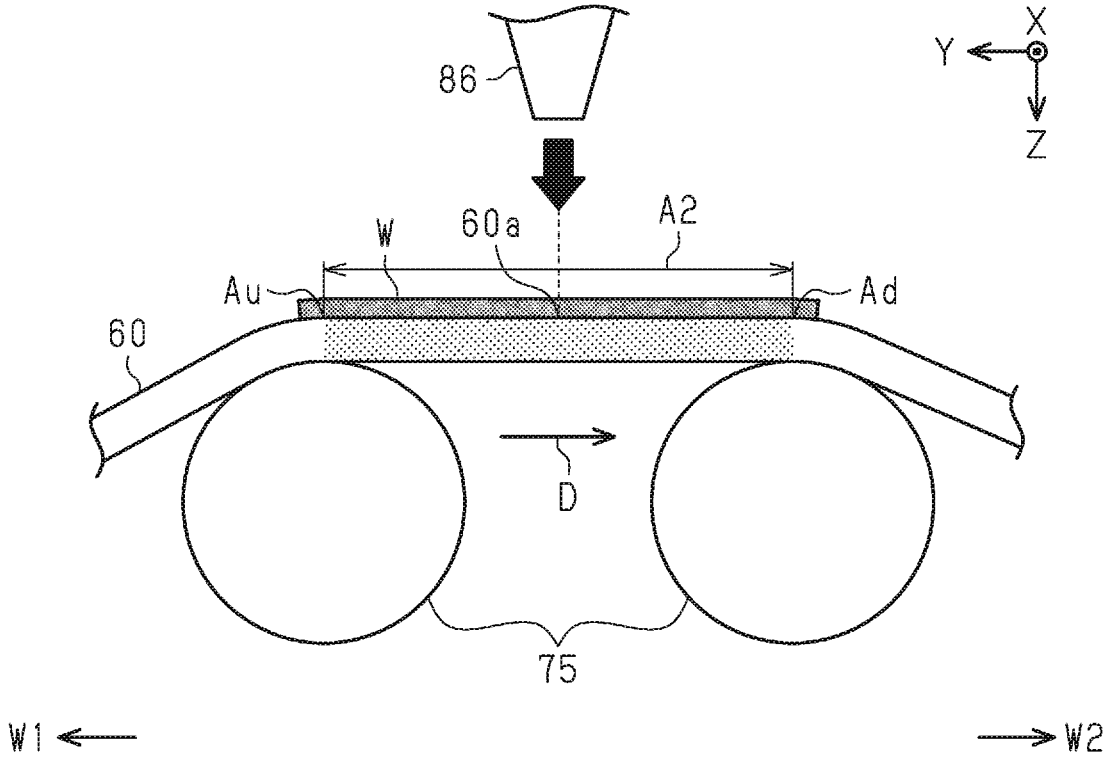
FIG. 10 is a schematic view for explaining supply of a wiping solution to a strip-shaped member according to the modification example.

As illustrated in FIGS. 9 and 10, the control portion 29 may cause the strip-shaped member 60 to supply the wiping solution W in a state in which the case 61 is caused to be positioned at the refilling position. The refilling position is a position at which the supply nozzle 86 faces the center of the contact region A2. Since the wiping solution W spreads from the catching portion 60*a*, the wiping solution W is likely to stay in the contact region A2 as the catching portion 60*a* is closer to the center of the contact region A2. Therefore, the control portion 29 may increase the amount of wiping solution W to be held in the contact region A2 by shortening the distance between the catching portion 60*a* and the center of the contact region A2. In other words, the amount of wiping solution W to be held in the contact region A2 may be reduced by extending the distance between the catching portion 60*a* and the center of the contact region A2. The control portion 29 may extend the distance between the catching portion 60*a* and the center of the contact region A2 as illustrated in FIG. 5 by causing the wiping solution W to be supplied in the state in which the case 61 is caused to be positioned at the standby position illustrated by the two-dotted dashed line in FIG. 9 before the first wiping operation. The control portion 29 may shorten the distance between the catching portion 60*a* and the center of the contact region A2 as illustrated in FIG. 10 by causing the wiping solution W to be supplied in the state in which the case 61 is caused to be positioned at the refilling position illustrated in the solid line in FIG. 9 before the second wiping operation.

The wiping mechanism 43 may be configured to wind the strip-shaped member 60 at the receiving position. The wiping mechanism 43 may be configured to wind the strip-shaped member 60 at both the standby position and the receiving position.

The direction in which the nozzle surface 40 is wiped off with the strip-shaped member 60 may be set to the same direction for the first wiping operation and the second wiping operation.

The number of pressing rollers 75 included in the wiping mechanism 43 may be one.

The wiping solution supply mechanism 80 may supply the wiping solution W to a region outside the contact region A2. For example, the first wiping operation in which the wiping-off direction is set to the second wiping-off direction W2 may be performed after the wiping solution W is supplied to the strip-shaped member 60 with the catching portion 60*a* located in the upstream region A1, and the second wiping operation in which the wiping-off direction is set to the first wiping-off direction W1 that is the opposite direction of the second wiping-off direction W2 may be performed after the winding operation of winding the strip-shaped member 60 around the winding portion 72 is performed and after the wiping solution W is supplied to the strip-shaped member 60 with the catching portion 60*a* located at center of the contact region A2. In this case, the distance between the catching portion 60*a* that receives the wiping solution W supplied before the wiping operation is performed and the front-side contact portion in the first wiping operation is longer than the distance between the catching portion 60*a* and the front-side contact portion in the second wiping operation. In this manner, the amount of wiping solution W to be held in the contact region A2 in the first wiping operation is smaller than that in the second wiping operation, and the amount of wiping solution held in the front-side contact portion in the first wiping operation is smaller than the amount of wiping solution to be held in the front-side contact portion in the second wiping operation.

Also, the first wiping operation in which the wiping-off direction is set to the second wiping-off direction W2 may be performed after the wiping solution W is supplied to the strip-shaped member 60 with the catching portion 60*a* located in the upstream region A1, and the second wiping operation in which the wiping-off direction is set to the first wiping-off direction W1 that is the opposite direction of the second wiping-off direction W2 may be performed without supplying the wiping solution W to the strip-shaped member 60 after the winding operation of winding the strip-shaped member 60 around the winding portion 72 with the catching portion 60*a* located at the position of the contact region A2 in the second wiping operation, for example. In this case, the distance between the catching portion 60*a* that receives the wiping solution W supplied before the wiping operation is performed and the front-side contact portion in the first wiping operation is longer than the distance between the catching portion 60*a* and the front-side contact portion in the second wiping operation. In this manner, the amount of wiping solution W to be held in the contact region A2 in the first wiping operation is smaller than that in the second wiping operation. Also, the strip-shaped member 60 may be wound around the winding portion 72 such that the catching portion 60*a* is located at a position in the contact region A2 that does not include the front-side contact portion in the second wiping operation. In this manner, the amount of wiping solution W to be held in the contact region A2 in the first wiping operation is smaller than that in the second wiping operation, and the amount of wiping solution held in the front-side contact portion in the first wiping operation is smaller than the amount of wiping solution to be held in the front-side contact portion in the second wiping operation.

For example, the first wiping operation in which the wiping-off direction is set to the second wiping-off direction W2 may be performed after the wiping solution W is supplied to the strip-shaped member 60 with the catching portion 60*a* located in the upstream region A1, and the second wiping operation in which the wiping-off direction is set to the first wiping-off direction W1 that is the opposite direction of the second wiping-off direction W2 may be performed without supplying the wiping solution W to the strip-shaped member 60 after the wiping solution W supplied to the upstream region A1 spreads in the contact region A2 with elapse of time. In this case, it is possible to extend the distance between the catching portion 60*a* that catches the wiping solution W supplied before the wiping operation is performed and the front-side contact portion in the first wiping operation as compared with the distance between the catching portion 60*a* and the front-side contact portion in the second wiping operation and to adjust the time interval from when the wiping solution W is supplied to the strip-shaped member 60 to when the wiping operation is performed. In this manner, the amount of wiping solution W to be held in the contact region A2 in the first wiping operation is smaller than that in the second wiping operation, and the amount of wiping solution held in the front-side contact portion in the first wiping operation is smaller than the amount of wiping solution to be held in the front-side contact portion in the second wiping operation.

The wiping solution supply mechanism 80 may supply the wiping solution W to a plurality of regions. For example, the control portion 29 may supply the wiping solution W over the upstream region A1 and the contact region A2 by causing the wiping solution W to be supplied while moving the case 61.

The control portion 29 may adjust the supply amount of wiping solution W to be supplied to the strip-shaped member 60 by controlling the driving of the supply pump 83. In this case, the wiping solution supply mechanism 80 may be configured not to include any opening/closing valves 85.

The amounts of wiping solution W supplied from the supply nozzles 86 to the strip-shaped member 60 may be the same amount for the first wiping operation and the second wiping operation. The supply amount in the second wiping operation may be set to be larger than that in the first wiping operation. It is possible to differently set the amounts of wiping solution W to be held in the contact region A2 in this case as well by differently setting the time interval from when the wiping solution W is supplied to the strip-shaped member 60 to when the wiping operation is performed or differently setting the distance between the catching portion 60*a* and the center of the contact region A2 for the first wiping operation and the second wiping operation.

The time interval from when the wiping solution W is supplied to the strip-shaped member 60 to when the wiping operation is performed may be such a time interval that the wiping solution W evaporates from the strip-shaped member 60. In this case, it is possible to adjust the amount of wiping solution W to be held in the strip-shaped member 60 by setting the aforementioned time interval without performing the control of adjusting the amount of wiping solution W to be supplied from the wiping solution supply mechanism 80 to the strip-shaped member 60, and thereby to simplify the control performed by the control portion 29.

The time intervals from when the wiping solution W is supplied to the strip-shaped member 60 to when the wiping operation is performed may be the same time for the first wiping operation and the second wiping operation. The aforementioned time interval in the second wiping operation may be longer than that in the first wiping operation. It is possible to differently set the amounts of wiping solution W to be held in the contact region A2 by differently setting the amount of wiping solution W to be supplied from the supply nozzle 86 to the strip-shaped member 60 or differently setting the distance between the catching portion 60*a* and the center of the contact region A2 for the first wiping operation and the second wiping operation.

The distances between the catching portion 60*a* and the front-side contact portion may be the same for the first wiping operation and the second wiping operation. The aforementioned distance in the second wiping operation may be longer than that in the first wiping operation. It is possible to differently set the amounts of wiping solution W to be held in the front-side contact portion in this case as well by differently setting the amount of wiping solution W to be supplied from the supply nozzle 86 to the strip-shaped member 60 or differently setting the time interval from when the wiping solution W is supplied to the strip-shaped member 60 to when the wiping operation is performed for the first wiping operation and the second wiping operation.

The wiping mechanism 43 may wipe off the wiping solution W adhering to the nozzle surface 40 after the second wiping operation is completed. Specifically, the nozzle surface 40 may be wiped off with the strip-shaped member 60 to which the wiping solution W has not been supplied after the second wiping operation is completed.

The first wiping operation may be performed without supplying the wiping solution W to the strip-shaped member 60. In this case, the amount of wiping solution W to be held in the contact region A2 in the first wiping operation is smaller than that in the second wiping operation by supplying the wiping solution W to the strip-shaped member 60 in the second wiping operation.

The control portion 29 may not successively perform the wiping operation twice. The control portion 29 may adjust the amount of wiping solution W to be held in the contact region A2 in accordance with a state of the liquid ejecting portion 20. For example, the amount of liquid adhering to the nozzle surface 40 after the suctioning cleaning is larger than the amount of liquid adhering to the nozzle surface 40 after printing. Therefore, the control portion 29 may reduce the amount of wiping solution W to be held in the contact region A2 in the wiping operation after the suctioning cleaning as compared with the amount of wiping solution W to be held in the contact region A2 in the wiping operation after printing. For example, the control portion 29 may perform first pressure cleaning with a large discharge amount and second pressure cleaning with a smaller discharge amount than that in the first pressure cleaning. The amount of liquid adhering to the nozzle surface 40 after the first pressure cleaning is larger than the amount of liquid adhering to the nozzle surface 40 after the second pressure cleaning. Therefore, the control portion 29 may reduce the amount of wiping solution W to be held in the contact region A2 in the wiping operation after the first pressure cleaning as compared with the amount of wiping solution W to be held in the contact region A2 in the wiping operation after the second pressure cleaning. For example, the liquid ejecting apparatus 11 may include a sensor that detects the amount of liquid adhering to the nozzle surface 40 and adjust the amount of wiping solution W to be held in the contact region A2 based on the detection result of the sensor.

The strip-shaped member 60 may be impregnated with an impregnating solution in advance. The impregnating solution preferably contains a penetrant and a humidifier.

The wiping solution W may contain additives that are contained in the impregnating solution.

The liquid ejecting apparatus 11 may be adapted such that the liquid ejecting portion 20 and the strip-shaped member 60 are provided so as to be able to relatively move in the gravity direction Z. For example, the control portion 29 may lift the horizontal region A4 after the pressure cleaning and bring the horizontal region A4 into contact with the liquid adhering to the nozzle surface 40. In this manner, the liquid adhering to the nozzle surface 40 is absorbed in the horizontal region A4 and decreases. Therefore, the control portion 29 may reduce the amount of wiping solution W to be held in the contact region A2 in the wiping operation performed without bringing the strip-shaped member 60 into contact with the liquid adhering to the nozzle surface 40 as compared with the wiping operation performed after the strip-shaped member 60 is brought into contact with the liquid adhering to the nozzle surface 40.

The liquid ejecting apparatus 11 may be a liquid ejecting apparatus configured to eject a liquid other than the ink. States of the liquid ejected from the liquid ejecting apparatus as a minute amount of liquid droplets include a particle form, a teardrop form, and a form with a string-like tail. The liquid described here may be any material that can be ejected by the liquid ejecting apparatus. For example, the liquid may be any substance in a liquid-phase state and includes fluids such as a liquid-form substance with high or low viscosity, a sol, a gel water, another inorganic solvent, an organic solvent, a solution, a liquid resin, a liquid metal, and a molten metal liquid. The liquid includes not only a liquid in one form of a substance but also includes particles a functional material made of solid such as a pigment or metal particles and dissolved, dispersed, or mixed in a solvent and the like. Representative examples of the liquid include the ink described above in the present embodiment, a liquid crystal, and the like. Here, the ink includes various liquid compositions such as a typical water-based ink, an oil-based ink, a gel ink, and a hot melt ink. Specific examples of the liquid ejecting apparatus include a device configured to eject a liquid which contains, in a dispersed or dissolved form, an electrode material, a coloring material, or the like that is used for manufacturing a liquid crystal display, an electroluminescence display, a surface light-emitting display, or a color filter, for example. The liquid ejecting apparatus may be a device configured to eject a bioorganic material used for producing a biochip, a device configured to eject a liquid that is used as a precision pipette and serves as a sample, a printing machine, a micro-dispenser, or the like. The liquid ejecting apparatus may be a device that ejects a lubricant to a precision machine such as a clock or a camera or a device that ejects, onto a substrate, a transparent resin solution such as an ultraviolet curable resin in order to form a micro-hemispherical lens, an optical lens, and the like used in an optical communication device or the like. The liquid ejecting apparatus may be a device configured to eject an acid or alkaline etching solution or the like to etch a substrate or the like.

Next, the impregnating solution with which the strip-shaped member 60 is impregnated will be described below in detail.

When the strip-shaped member 60 is impregnated with the impregnating solution, the pigment particles are more likely to move from the surface to the inside of the strip-shaped member 60, and the pigment particles are more unlikely to remain on the surface of the strip-shaped member 60. The impregnating solution preferably contains a penetrant and a humidifier. In this manner, the pigment particles are more likely to be absorbed by the strip-shaped member 60. Also, the impregnating solution is not particularly limited as long as the liquid can cause inorganic pigment particles to move from the surface to the inside of the strip-shaped member 60.

The surface tension of the impregnating solution is preferably equal to or less than 45 mN/m and equal to or less than 35 mN/m. When the surface tension is low, permeability of the inorganic pigment into the strip-shaped member 60 becomes satisfactory, and wiping properties are improved. As a method of measuring the surface tension, it is possible to exemplify a method of measuring the surface tension at a liquid temperature of 25° C. by a Wilhelmy method using a surface tension meter that is typically used, for example, a surface tension meter CBVP-Z manufactured by Kyowa Interface Science, Inc. or the like.

The content of the impregnating solution is preferably equal to or greater than 10% by mass and equal to or less than 200% by mass and is more preferably equal to or greater than 50% by mass and equal to or less than 100% by mass with respect to 100% by mass of the strip-shaped member 60. By the content of the impregnating solution being equal to or greater than 10% by mass, the inorganic pigment ink is likely to penetrate to the inside of the strip-shaped member 60, and it is possible to further curb damage on a water-repellent film. Also, by the content of the impregnating solution being equal to or less than 200% by mass, it is possible to further curb remaining of the impregnating solution on the nozzle surface 40 and to further curb dot missing due to invasion of air bubbles with the impregnating solution into the nozzles 36 and dot missing due to invasion of the impregnating solution itself into the nozzles 36.

In addition, although additives that may be contained in the impregnating solution, that is, components of the impregnating solution are not particularly limited, examples thereof include a resin, an antifoaming agent, a surfactant, water, an organic solvent, a pH adjusting agent, and the like. The aforementioned components may be used alone or in combination of two or more thereof, and the content thereof is not particularly limited.

When the impregnating solution contains an antifoaming agent, it is possible to effectively prevent the impregnating solution remaining on the nozzle surface 40 after the cleaning treatment from foaming. Also, the impregnating solution may contain a large amount of acid humidifier such as polyethylene glycol or glycerin, and in such a case, it is typically possible to avoid contact of an acid impregnating solution with a basic ink composition with pH of equal to or greater than 7.5 when the impregnating solution contains a pH adjusting agent. In this manner, it is possible to prevent the ink composition from shifting on the acid side, and preservation stability of the ink composition is further maintained.

Also, any humidifier can be used as the humidifier that may be contained in the impregnating solution without particular limitation as long as the humidifier can typically be used in an ink or the like. Although the humidifier is not particularly limited, it is possible to use a high-boiling-point humidifier, the boiling point of which is preferably equal to or greater than 180° C. and is more preferably equal to or greater than 200° C. under 1 atm. When the boiling point falls within the aforementioned range, it is possible to prevent volatile components in the impregnating solution from being volatilized and to effectively perform wiping by reliably wetting the ink composition that is brought into contact with the impregnating solution.

The high-boiling-point humidifier is not particularly limited, and examples thereof include ethylene glycol, propylene glycol, diethylene glycol, triethylene glycol, pentamethylene glycol, trimethylene glycol, 2-butene-1,4-diol, 2-ethyl-1,3-hexanediol, 2-methyl-2,4-pentanediol, tripropylene glycol, polyethylene glycol, polypropylene glycol, 1,3-propylene glycol, isopropylene glycol, isobutylene glycol, glycerin, mesoerythritol, pentaerythritol, and the like.

The humidifiers may be used alone or as a mixture of two or more thereof. The content of the humidifier is preferably 10 to 100% by mass with respect to 100% by mass, which is the total mass of the impregnating solution. Also, the expression that the content of the humidifier is 100% by mass with respect to the total mass of the impregnating solution means that the component of the impregnating solution is only the humidifier.

A penetrant among the additives that may be contained in the impregnating solution will be described. Any penetrant can be used without particular limitation as long as the penetrant can typically be used in an ink or the like, and it is also possible to employ a solution containing 90% by mass of water and 10% by mass of penetrant with surface tension of equal to or less than 45 mN/m as the penetrant. Although the penetrant is not particularly limited, it is possible to exemplify at least one selected from the group consisting of alkanediols having 5 to 8 carbon atoms, glycol ethers, acetylene glycol-based surfactants, siloxane-based surfactants, and fluorine-based surfactants. Also, the measurement of the surface tension can be performed by the aforementioned method.

Also, the content of the penetrant in the impregnating solution is preferably equal to or greater than 1% by mass and equal to or less than 40% by mass and is further preferably equal to or greater than 3% by mass and equal to or less than 25% by mass. There is a trend that more excellent wiping properties are achieved by the content being equal to or greater than 1% by mass, and it is possible to avoid the penetrant attacking the pigment contained in the ink in the vicinity of the nozzles 36, breaking dispersion stability, and causing aggregation, by the content of the penetrant being equal to or less than 40% by mass.

Although the alkanediols having 5 to 8 carbon atoms are not particularly limited, examples thereof include 1,2-pentanediol, 1,5-pentanediol, 1,2-hexanediol, 1,6-hexanediol, 1,2-heptanediol, 2-ethyl-1,3-hexanediol, 2,2-dimethyl-1,3-propanediol, 2,2-dimethyl-1,3-hexanediol, and the like. The alkanediols having 5 to 8 carbon atoms may be used alone or in combination of two or more thereof.

Although the glycol ethers are not particularly limited, examples thereof include ethylene glycol mono-n-butyl ether, ethylene glycol mono-t-butyl ether, diethylene glycol mono-n-butyl ether, triethylene glycol mono-n-butyl ether, diethylene glycol mono-t-butyl ether, propylene glycol monomethyl ether, propylene glycol monoethyl ether, propylene glycol mono-t-butyl ether, propylene glycol mono-n-propyl ether, propylene glycol mono-iso-propyl ether, propylene glycol mono-n-butyl ether, dipropylene glycol mono-n-butyl ether, dipropylene glycol mono-n-propyl ether, dipropylene glycol mono-iso-propyl ether, diethylene glycol dimethyl ether, diethylene glycol diethyl ether, diethylene glycol dibutyl ether, diethylene glycol ethyl methyl ether, diethylene glycol butyl methyl ether, triethylene glycol dimethyl ether, tetraethylene glycol dimethyl ether, dipropylene glycol dimethyl ether, dipropylene glycol diethyl ether, tripropylene glycol dimethyl ether, ethylene glycol monoisohexyl ether, diethylene glycol monoisohexyl ether, triethylene glycol monoisohexyl ether, ethylene glycol monoisoheptyl ether, diethylene glycol monoisoheptyl ether, triethylene glycol monoisoheptyl ether, ethylene glycol monoisooctyl ether, diethylene glycol monoisooctyl ether, triethylene glycol monoisooctyl ether, ethylene glycol mono-2-ethyl hexyl ether, diethylene glycol mono-2-ethyl hexyl ether, triethylene glycol mono-2-ethyl hexyl ether, diethylene glycol mono-2-ethyl pentyl ether, ethylene glycol mono-2-ethyl pentyl ether, ethylene glycol mono-2-methyl pentyl ether, diethylene glycol mono-2-methyl pentyl ether, and the like. The glycol ethers may be used alone or in combination of two or more thereof.

Although the acetylene glycol-based surfactant is not particularly limited, examples thereof include compounds represented by the following formulae.

(1)

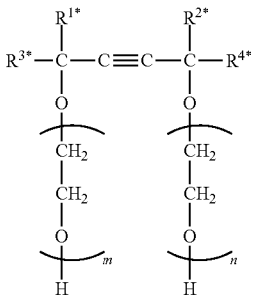

[In Formula (1), $0 \leq m+n \leq 50$, and $R^{1*}$, $R^{2*}$, $R^{3*}$, and $R^{4*}$ each independently represent an alkyl group and each preferably represent an alkyl group having 1 to 6 carbon atoms.]

Among the acetylene glycol-based surfactants represented by Formula (1), preferable examples include 2,4,7,9-tetramethyl-5-decyne-4,7-diol, 3,6-dimethyl-4-octyn-3,6-diol, 3,5-dimethyl-1-hexyne-3ol, and the like. Marketed products can also be used as the acetylene glycol-based surfactants represented by Formula (1), and specific examples thereof include Surfynol 82, 104, 440, 465, 485, and TG which are available from Air Products and Chemicals. Inc., Olfine STG manufactured by Nissin Chemical Co., Ltd., Olfine E1010 manufactured by Nissin Chemical Co., Ltd., and the like. The acetylene glycol-based surfactants may be used alone or in combination of two or more thereof.

Although the siloxane-based surfactants are not particularly limited, examples thereof include those represented by Formula (2) or (3) below.

(2)

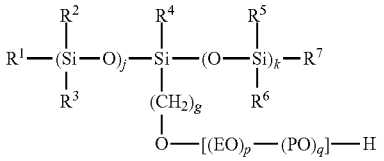

[In Formula (2), $R^1$, $R^2$, $R^3$, $R^4$, $R^5$, $R^6$, and $R^7$ each independently represent an alkyl group having 1 to 6 carbon atoms and preferably represents a methyl group. j and k each independently represent an integer that is equal to or greater than 1, preferably represent 1 to 5, more preferably represent 1 to 4, further preferably represent 1 or 2, and preferably satisfy j=k=1 or k=j+1. Also, g represents an integer that is equal to or greater than 0, preferably represents 1 to 3, and more preferably represents 1. Further, p and q each represent an integer that is equal to or greater than 0 and preferably represent 1 to 5. However, p+q is an integer that is equal to or greater than 1, and p+q is preferably 2 to 4.]

As the siloxane-based surfactants represented by Formula (2), a compound in which all of $R^1$ to $R^7$ represent methyl groups, j represents 1 or 2, k represents 1 or 2, g represents 1 or 2, p represents an integer that is equal to or greater than 1 and equal to or less than 5, and q is 0 is preferably used.

(3)

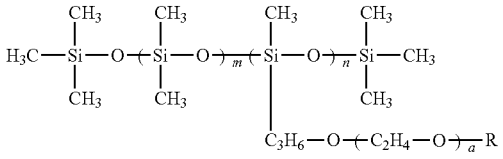

[In Formula (3), R represents a hydrogen atom or a methyl group, a represents an integer of from 2 to 18, m represents an integer of from 0 to 50, and n represents an integer of from 1 to 5.]

Although the siloxane-based surfactants represented by Formula (3) are not particularly limited, preferable examples thereof include compounds in which R represents a hydrogen atom or a methyl group, a represents an integer of from 7 to 11, m represents an integer of from 30 to 50, and n represents an integer of from 3 to 5, compounds in which R represents a hydrogen atom or a methyl group, a represents an integer of from 9 to 13, m represents an integer of from 2 to 4, and n is an integer that is 1 or 2, compounds in which R represents a hydrogen atom or a methyl group, a represents an integer of from 6 to 18, m represents an integer that is 0, and n represents an integer that is 1, and compounds in which R represents a hydrogen atom, a represents an integer of from 2 to 5, m represents an integer of from 20 to 40, and n represents an integer of from 3 to 5.

Commercially available marketed siloxane-based surfactants may also be used, and examples thereof include Olfine PD-501 manufactured by Nissin Chemical Co., Ltd., Olfine PD-570 manufactured by Nissin Chemical Co., Ltd., BYK-347 manufactured by BYK Japan KK, BYK-348 manufactured by BYK Japan KK, and the like. The aforementioned siloxane-based surfactants may be used alone or in combination of two or more thereof.

The fluorine-based surfactants are known as solvents that exhibit satisfactory wettability with respect to a low-absorbable or unabsorbable medium 14 as disclosed in WO2010/050618 and WO2011/007888. Although the fluorine-based surfactants are not particularly limited, any fluorine-based surfactant can appropriately be selected in accordance with purposes, and examples thereof include a perfluoroalkylsulfonic acid salt, a perfluoroalkylcarboxylic acid salt, a perfluoroalkylphosphoric acid ester, a perfluoroalkylethylene oxide adduct, perfluoroalkyl betaine, perfluoroalkylamine oxide compound, and the like.

In addition to the aforementioned examples, an appropriately synthesized one may be used, or a marketed product may be used, as the fluorine-based surfactant. Examples of the marketed product include S•144 and S•145 manufactured by AGC Inc.; FC•170C, FC•430, and Fluorad•FC4430 manufactured by 3M Japan Limited; FSO, FSO•100, FSN, FSN•100, and FS•300 manufactured by Dupont; FT•250 and 251 manufactured by Neos Company Limited; and the like. Among these, FSO, FSO•100, FSN, FSN•100, and FS•300 manufactured by Dupont are preferably employed. The fluorine-based surfactants may be used alone or in combination of two or more thereof.

Next, an ink that is a liquid used by the liquid ejecting portion 20 will be described below in detail.

The ink used by the liquid ejecting apparatus 11 contains a resin in the composition thereof and does not substantially contain glycerin with a boiling point of 290° C. under 1 atm. When the ink substantially contains glycerin, drying properties of the ink are significantly degraded. As a result, not only significant irregularity of concentration in an image on various media 14, particularly ink unabsorbable or low-absorbable media 14 is achieved, but also ink fixability cannot be obtained. Further preferably, the ink does not substantially contain alkyl polyols with a boiling point of equal to or higher than 280° C. under 1 atm, except for the aforementioned glycerin.

Here, "substantially not contain" in the specification means that the substance is not contained exceeding the amount with which addition has sufficient meaning. When this is quantitatively expressed, the content of glycerin is preferably not equal to or greater than 1.0% by mass, is more preferably not equal to or greater than 0.5% by mass, is further preferably not equal to or greater than 0.1% by mass, is still further preferably not equal to or greater than 0.05% by mass, and is particularly preferably not equal to or greater than 0.01% by mass with respect to 100% by mass, which is a total mass of the ink. Also, the content of glycerin is most preferably not equal to or greater than 0.001% by mass.

Liquid Repellency

A liquid repellent film may be formed on the nozzle surface 40. The liquid repellent films are not particularly limited as long as the films have liquid repellency. The liquid repellent films can be formed by forming metal alkoxide molecular films with liquid repellency and then performing drying processing, annealing processing, and the like thereon, for example. Although any metal alkoxide molecular films may be employed as long as the metal alkoxide molecular films have liquid repellency, it is desirable to employ single-molecular films of metal alkoxide having a long-chain polymer group (long-chain RF group) containing fluorine or single-molecular films of metal acid salts having a repellent group (for example, a long-chain polymer group containing fluorine). Although metal alkoxide is not particularly limited, types of metal typically used include, for example, silicon, titanium, aluminum, and zirconium. Examples of the long-chain RF groups include a perfluoroalkyl chain and a perfluoropolyether chain. Examples of alkoxysilane having the long-chain RF group include a silane coupling agent having the long-chain RF group. In addition, it is also possible to use, as the liquid repellent films, silane coupling agent (SCA) films and those disclosed in Japanese Patent No. 4424954, for example.

Although the conductive films may be formed on the surface of the cover member 38, and the liquid repellent films may be formed on the conductive films, underlayer films (plasma polymerized silicone (PPSi) films) may be formed through plasma polymerization of a silicone material first, and the liquid repellent films may be formed on the underlayer films. It is possible to allow the silicone material of the cover member 38 to conform to the liquid repellent films by interposing the underlayer films therebetween.

The liquid repellent films preferably have a thickness of equal to or greater than 1 nm and equal to or less than 30 nm. When the thickness falls within such a range, the cover member 38 is likely to have more excellent liquid repellency, degradation of the films is relatively delayed, and it is possible to maintain the liquid repellency in a longer period of time. Also, more excellent properties are achieved in terms of costs and easiness in forming the films. Also, the thickness is more preferably equal to or greater than 1 nm and equal to or less than 20 nm and is further preferably equal to or greater than 1 nm and equal to or less than 15 nm in terms of easiness in forming the films.

Ink Composition

Next, an ink composition containing an inorganic pigment (hereinafter, referred to as an inorganic pigment-containing ink composition) and additives (components) that are or may be contained in an ink composition containing a coloring material other than the inorganic pigment (hereinafter, referred to as an inorganic pigment non-containing ink composition) will be described. The ink composition is configured of a coloring material (an inorganic pigment, an organic pigment, a dye, or the like) a solvent (water, an organic solvent, or the like), a resin, a surfactant, and the like.

Coloring Material

The inorganic pigment-containing ink composition contains, as a coloring material, an inorganic pigment in a range of equal to or greater than 1.0% by mass and equal to or less than 20.0% by mass. When the inorganic pigment-containing ink composition is a white ink composition, in particular, the concentration of inorganic pigment is preferably equal to or greater than 5% by mass.

Also, an inorganic pigment non-containing ink composition may contain a coloring material selected from a pigment other than the inorganic pigment and a dye.

Pigment

An average particle diameter of the inorganic pigment contained in the inorganic pigment-containing ink composition is preferably equal to or greater than 20 nm and equal to or less than 250 nm and is more preferably equal to or greater than 20 nm and equal to or less than 200 nm.

Also, a needle shape ratio of the inorganic pigment is preferably equal to or less than 3.0. It is possible to satisfactorily protect the liquid repellent films according to the disclosure of the application by setting such a needle shape ratio. The needle shape ratio is a value obtained by dividing the maximum length of each particle by a minimum width (needle shape ratio=maximum length of particle/minimum width of particle). For specifying the needle shape ratio, it is possible to perform measurement using a transmission-type electronic microscope.

Also, Mohs hardness of the inorganic pigment exceeds 2.0 and is preferably equal to or greater than 5 and equal to or less than 8.

Examples of the inorganic pigment include single metal such as carbon black, gold, silver, copper, aluminum, nickel, and zinc; oxides such as cerium oxide, chromium oxide, aluminum oxide, zinc oxide, magnesium oxide, silicon oxide, tin oxide, zirconium oxide, iron oxide, and titanium oxide; sulfates such as calcium sulfate, barium sulfate, and aluminum sulfate; silicates such as calcium silicate and magnesium silicate; nitrides such as boron nitride and titanium nitride; carbides such as silicon carbide, titanium carbide, boron carbide, tungsten carbide, and zirconium carbide; borides such as zirconium boride and titanium boride; and the like. Examples of the inorganic pigments that are preferable among these include aluminum, aluminum oxide, titanium oxide, zinc oxide, zirconium oxide, silicon oxide, and the like. More preferable examples include titanium oxide, silicon oxide, and aluminum oxide. Rutile titanium oxide has Mohs hardness of about 7 to 7.5 while anatase titanium oxide has Mohs hardness of about 6.6 to 6. Rutile titanium oxide is a preferable crystal system due to low manufacturing costs, and it is also possible to exhibit satisfactory whiteness. Therefore, the liquid ejecting apparatus 11 that has liquid repellent film preservability and is capable of producing a recorded product with satisfactory whiteness at low costs can be obtained when rutile titanium dioxide is used.

Although the organic pigment is not particularly limited, examples thereof include a quinacridone-based pigment, a quinacridonequinone-based pigment, a dioxazine-based pigment, a phthalocyanine-based pigment, an anthrapyrimidine-based pigment, an anthanthrone-based pigment, an indanthrone-based pigment, a flavanthrone-based pigment, a perylene-based pigment, a diketopyrrolopyrrole-based pigment, a perinone-based pigment, a quinophthalone-based pigment, an anthraquinone-based pigment, a thioindigo-based pigment, a benzimidazolone-based pigment, an isoindolinone-based pigment, an azomethine-based pigment, an azo-based pigment, and the like. Specific examples of the organic pigment are listed below.

Examples of a pigment that is used in a cyan ink include C.I. Pigment Blue 1, 2, 3, 15, 15:1, 15:2, 15:3, 15:4, 15:6, 15:34, 16, 18, 22, 60, 65, 66, C.I. Vat Blue 4 and 60, and the like. Among these, at least either C.I. Pigment Blue 15:3 or 15:4 is preferably employed.

Examples of a pigment that is used in a magenta ink include C.I. Pigment Red 1, 2, 3, 4, 5, 6, 7, 8, 9, 10, 11, 12, 14, 15, 16, 17, 18, 19, 21, 22, 23, 30, 31, 32, 37, 38, 40, 41, 42, 48 (Ca), 48 (Mn), 57 (Ca), 57:1, 88, 112, 114, 122, 123, 144, 146, 149, 150, 166, 168, 170, 171, 175, 176, 177, 178, 179, 184, 185, 187, 202, 209, 219, 224, 245, 254, and 264, C.I. Pigment Violet 19, 23, 32, 33, 36, 38, 43, and 50, and the like. Among these, at least one selected from the group consisting of C.I. Pigment Red 122, C.I. Pigment Red 202, and C.I. Pigment Violet 19 are preferably employed.

Examples of a pigment used in a yellow ink include C.I. Pigment Yellow 1, 2, 3, 4, 5, 6, 7, 10, 11, 12, 13, 14, 16, 17, 24, 34, 35, 37, 53, 55, 65, 73, 74, 75, 81, 83, 93, 94, 95, 97, 98, 99, 108, 109, 110, 113, 114, 117, 120, 124, 128, 129, 133, 138, 139, 147, 151, 153, 154, 155, 167, 172, 180, 185, and 213 and the like. Among these, at least one selected from the group consisting of C.I. Pigment Yellow 74, 155, and 213 are preferably employed.

Also, examples of a pigment used in an ink of a color other than the aforementioned colors, such as a green ink or an orange ink, include ones that are known in the related art.

An average particle diameter of the pigment other than the inorganic pigment is preferably equal to or less than 250 nm since it is possible to curb clogging of the nozzles 36 and to achieve further satisfactory ejection stability.

Also, the average particle diameter in the specification is based on volume. As a measurement method, it is possible to perform the measurement using a granularity distribution measurement device employing a laser diffraction scattering method as a measurement principle, for example. Examples of the granularity distribution measurement device include a granularity distribution meter (for example, Microtrac UPA manufactured by Nikkiso Co., Ltd.) employing a dynamic light scattering method as a measurement principle.

Dye

It is possible to use a dye as the coloring material. The dye is not particularly limited, and it is possible to use an acidic dye, a direct dye, a reactive dye, and a basic dye.

The content of the coloring material is preferably 0.4 to 12% by mass and is more preferably 2 to 5% by mass with respect to the total mass (100% by mass) of the ink composition.

Resin

Examples of the resin include a resin dispersant, a resin emulsion, a wax, and the like. Among these, an emulsion is preferably employed due to its satisfactory adhesiveness and rubbing resistance.

The inorganic pigment-containing ink composition preferably has the following feature 1. or 2. in terms of the composition.

1. The ink jet recording ink composition contains a first resin with a thermal deformation temperature of equal to or lower than 10° C. (hereinafter, referred to as a "first ink").

2. The ink jet recording ink composition contains a second resin and substantially does not contain glycerin (hereinafter, referred to as a "second ink").

Although these ink compositions have a characteristic that the ink compositions are likely to be solidified on the nozzle surface 40 and the strip-shaped member 60, and are likely to promote damage on the liquid repellent films, it is possible to satisfactorily prevent such trends according to the disclosure of the present application.

The aforementioned first ink contains the first resin with the thermal deformation temperature of equal to or lower than 10° C. Such a resin has a characteristic that the resin fixedly adheres to a material with high flexibility and high absorbability such as a fabric. Meanwhile, film coating and solidification rapidly advance, and the resin adheres, as a solid, to the nozzle surface 40, the strip-shaped member 60, and the like.

The aforementioned second ink substantially does not contain glycerin with a boiling point of 290° C. under 1 atm. When the colored ink substantially contains glycerin, drying properties of the ink are significantly degraded. As a result, not only significant irregularity of concentration in an image on various media 14, particularly ink unabsorbable or low-absorbable media 14 is achieved, but also ink fixability cannot be obtained. Also, when glycerin is not contained, water and the like as a main solvent in the ink is rapidly volatilized, and the proportion of the organic solvent in the second ink increases. In this case, the thermal deformation temperature (particularly, a film increasing temperature) of the resin is lowered as a result, and solidification due to coated film is further promoted. Further preferably, the colored ink substantially does not contain alkylpolyols (except for glycerin described above) with a boiling point of equal to or higher than 280° C. under 1 atm. Although in the case of the second ink, drying of the ink around the liquid ejecting portion 20 advances, and the problem further significantly appears in a case of the liquid ejecting apparatus 11 provided with a heating mechanism configured to heat the medium 14 that has been transported to a position that faces the liquid ejecting portion 20, it is possible to satisfactorily prevent this according to the disclosure of the application. The heating temperature is preferably equal to or greater than 30° C. and equal to or less than 80° C. in terms of ink preservation stability and recorded image quality. The heating mechanism is not particularly limited, and examples thereof include a heat generating heater, a hot wind heater, an infrared heater, and the like.

Here, "substantially not contain" in the specification means that the substance is not contained exceeding the amount with which addition has sufficient meaning. When this is quantitatively expressed, the content of glycerin is preferably not equal to or greater than 1.0% by mass, is more preferably not equal to or greater than 0.5% by mass, is further preferably not equal to or greater than 0.1% by mass, is still further preferably not equal to or greater than 0.05% by mass, is particularly preferably not equal to or greater than 0.01% by mass, and is most preferably not equal to or greater than 0.001% by mass with respect to the total mass (100%) by mass of the colored ink.

A thermal deformation temperature of the first resin is preferably equal to or lower than 10° C. Further, the thermal deformation temperature is preferably equal to or lower than −10° C. and is more preferably equal to or less than −15° C. When a glass transition temperature of a fixation resin falls within the aforementioned range, further excellent fixability of the pigment in a recorded product is achieved, and as a result, excellent rubbing resistance is achieved. Also, although a lower limit of the thermal deformation temperature is not particularly limited, the lower limit may be equal to or greater than −50° C.

A lower limit of the thermal deformation temperature of the second resin is preferably equal to or higher than 40° C. and is more preferably equal to or higher than 60° C. in order to reduce clogging of the head and to achieve satisfactory rubbing resistance of the recorded product. A preferable upper limit is equal to or lower than 100° C.

Here, the "thermal deformation temperature" in the specification is assumed to be a temperature value represented by a glass transition temperature (Tg) or a minimum film forming temperature (MFT). In other words, "the thermal deformation temperature of equal to or higher than 40° C." means that it is only necessary for either Tg or MFT to be equal to or higher than 40° C. Also, since it is easier to recognize relative merits of re-dispersibility of the resin with MFT than with Tg, the thermal deformation temperature is preferably a temperature value represented by MFT. Since the ink composition with excellent resin re-dispersibility does not adhere in a solidified manner, the head is unlikely to cause clogging.

As Tg in the specification, a value measured by differential scanning calorimetry will be described. Also, a value measured based on ISO 2115:1996 (title: plastic-polymer dispersion-measurement of white point temperature and minimum film forming temperature) will be described as MFT in the specification.

Resin Dispersant

Since the pigment can be stably dispersed and held in water when the ink composition contains the aforementioned pigment, it is better for the ink composition to contain a resin dispersant. By the ink composition containing the pigment dispersed using the resin dispersant, such as a water-soluble resin or a water dispersible resin (hereinafter, referred to as a "resin dispersed pigment"), it is possible to obtain satisfactory adhesiveness at least either between the medium 14 and the ink composition or between solidified substances in the ink composition when the ink composition adheres to the medium 14. The water-soluble resin is preferably employed among the resin dispersants due to its excellent dispersion stability.

Resin Emulsion

The ink composition may contain a resin emulsion. The resin emulsion exhibits an effect that the ink composition is sufficiently fixed to the medium 14 and satisfactory rubbing resistance of the image is achieved, by forming a resin coating film. A recorded product recorded using the ink composition containing the resin emulsion has excellent adhesiveness and rubbing resistance on a cloth or an ink unabsorbable or low-absorbable medium 14, in particular, due to the aforementioned effect. Meanwhile, although the resin emulsion is likely to promote solidification of the inorganic pigment, it is possible to satisfactorily prevent a problem of degradation of the liquid repellent films, which occurs when a solidified adhering substance is wiped, according to the disclosure of the application.

Also, the resin emulsion that serves as a binder is preferably contained in an emulsion form in the ink composition. The viscosity of the ink composition is easily adjusted in a proper range in the ink jet recording scheme, and excellent preservation stability and ejection stability of the ink composition are achieved by containing the resin that serves as a binder in an emulsion form in the ink composition.

Although the resin emulsion is not particularly limited, examples thereof include (meth)acrylic acid, (meth)acrylic acid ester, acrylonitrile, cyanoacrylate, acrylamide, olefin, styrene, vinyl acetate, vinyl chloride, vinyl alcohol, vinyl ether, vinyl pyrrolidone, vinyl pyridine, vinyl carbazole, vinyl imidazole, a single polymer or a copolymer of vinylidene chloride, a fluorine resin, a natural resin, and the like. Among these, at least either a (meth)acrylic resin or styrene-(meth)acrylic acid copolymer-based resin is preferably employed, at least either the acrylic resin or a styrene-acrylic acid copolymer-based resin is more preferably employed, and a styrene-acrylic acid copolymer-based resin is further preferably employed. Also, the aforementioned copolymer may be in any form among a random copolymer, a block copolymer, an alternating copolymer, and a graft copolymer.

As the resin emulsion, a marketed product may be used, or the resin emulsion may be produced using an emulsion polymerization method or the like as follows. As a method for obtaining a resin in an emulsion state in the ink composition, it is possible to exemplify a method of emulsifying and polymerizing a monomer of the aforementioned water-soluble resin in water in which a polymerization catalyst and an emulsifier are present. A polymerization initiator, an emulsifier, and a molecular weight adjusting agent used for emulsification polymerization can be used in accordance with a method that is known in the related art.

An average particle diameter of the resin emulsion is preferably within a range of 5 nm to 400 nm and is more preferably within a range of 20 nm to 300 nm in order to achieve further satisfactory ink preservation stability and ejection stability.

The resin emulsions may be used alone or in combination of two or more thereof. The content of the resin emulsion in the resin is preferably within a range of 0.5 to 15% by mass with respect to the total mass (100% by mass) of the ink composition. When the content falls within the aforementioned range, it is possible to reduce the concentration of the solid content and thereby to achieve further satisfactory ejection stability.

Wax

The ink composition may contain a wax. The ink composition have more excellent fixability on the ink unabsorbable and low-absorbable media 14 by containing the wax. Among waxes, a wax of an emulsion type or a suspension type is more preferably employed. Preferable examples of the wax include a polyethylene wax, a paraffine wax, and a polypropylene wax, and in particular, a polyethylene wax, which will be described later, is preferably employed although not limited thereto.

It is possible to achieve excellent ink rubbing resistance by the ink composition containing a polyethylene wax.

An average particle diameter of the polyethylene wax is preferably within a range of 5 nm to 400 nm and is more preferably within a range of 50 nm to 200 nm in order to achieve further satisfactory ink preservation stability and ejection stability.

The content (in terms of solid content) of polyethylene wax is preferably within a range of 0.1 to 3% by mass, is more preferably within a range of 0.3 to 3% by mass, and is further preferably within a range of 0.3 to 1.5% by mass with respect to the total mass (100% by mass) of the ink composition. When the content falls within the aforementioned range, it is possible to satisfactorily solidify and fix the ink composition on and to the medium 14 and to achieve more excellent ink preservation stability and ejection stability.

Antifoaming Agent

The ink composition may contain an antifoaming agent. More specifically, at least either the ink composition or the impregnating solution may contain the antifoaming agent. When the ink composition contain the antifoaming agent, it is possible to curb foaming and, as a result, to reduce the concern that foam enters the nozzles 36.

Examples of the antifoaming agent include a silicone-based antifoaming agent, a polyether-based antifoaming agent, an aliphatic acid ester-based antifoaming agent, an acetylene glycol-based antifoaming agent, and the like although not limited thereto. Among these, the silicone-based antifoaming agent or an acetylene glycol-based antifoaming agent is preferably employed since they have excellent ability of appropriately keeping the surface tension and interfacial tension and substantially no air bubbles are generated. Also, an HLB value of the antifoaming agent based on a Griffin method is more preferably equal to or less than 5.

Surfactant

The ink composition may include surfactants (excluding those listed in the above antifoaming agents. That is, the HLB value by the Griffin method is limited to more than 5). Examples of the surfactant include nonionic surfactants although not limited to those listed below. The nonionic surfactants have an effect of uniformly spreading the ink on the medium 14. Therefore, it is possible to obtain a fine image with substantially no bleeding when ink jet recording is performed using an ink containing a nonionic surfactant. Examples of such a nonionic surfactant include a silicone-based surfactant, a polyoxyethylene alkyl ether-based surfactant, a polyoxypropylene alkyl ether-based surfactant, a polycyclic phenyl ether-based surfactant, a sorbitan derivative, a fluorine-based surfactant, and the like although not limited thereto, and among these, a silicone-based surfactant is preferably employed.

The silicone-based surfactant has an excellent effect of uniformly spreading the ink such that no bleeding occurs on the medium 14 as compared with other nonionic surfactants.

The surfactants may be used alone or as a mixture of two or more thereof. The content of the surfactant is preferably equal to or greater than 0.1% by mass and equal to or less than 3% by mass with respect to the total mass (100% by mass) of the ink since further satisfactory ink preservation stability and ejection stability are achieved.

Water

The ink composition may contain water. When the ink composition is a water-based ink, in particular, water is a main component of the ink, and the component is evaporated and flies over when the medium 14 is heated in ink jet recording.

Examples of water include pure water such as ion exchanged water, ultrafiltration water, reverse osmotic water, and distilled water and water from which ionic impurities have been removed to the maximum extent, such as ultrapure water. Also, when water sterilized by irradiation with ultraviolet rays, addition of hydrogen peroxide, or the like is used, it is possible to prevent mold and bacteria from being generated when the pigment dispersion and the ink using it are preserved for a long period of time.

The content of water is not particularly limited and may appropriately be determined as needed.

Surface Tension of Ink Composition

Surface tension of the ink composition is not particularly limited and is preferably 15 to 35 mN/m. In this manner, it is possible to secure permeability of the ink composition into the strip-shaped member 60 and bleeding preventing properties at the time of recording, and ink wiping properties at the time of a cleaning operation is improved. The surface tension of the ink composition can be also measured by using, for example, a typically used surface tension meter (for example, a surface tension meter CBVP-Z manufactured by Kyowa Interface Science, Inc. or the like) as described above. Also, a difference between the surface tension of the ink composition and the surface tension of the cleaning solution is preferably in a relationship within 10 mN/m. In this manner, it is possible to prevent the surface tension of the ink composition from extremely decreasing when both the ink composition and the cleaning solution are mixed around the nozzles 36.

Hereinafter, technical ideas and effects and advantages thereof that can be understood from the aforementioned embodiment and modification examples will be described.

A. A liquid ejecting apparatus includes: a liquid ejecting portion configured to eject a liquid from a nozzle disposed in a nozzle surface; a wiping mechanism configured to execute a wiping operation of wiping the nozzle surface with a strip-shaped member, which is configured to absorb the liquid ejected by the liquid ejecting portion, in contact with the nozzle surface; a wiping solution supply mechanism configured to supply a wiping solution to the strip-shaped member before the wiping operation is performed; and a control portion, and the control portion reduces the amount of the wiping solution held in a contact region of the strip-shaped member that comes into contact with the nozzle surface in the wiping operation when the nozzle surface with a large amount of the liquid adhering thereto is wiped as compared with the amount of the wiping solution when the nozzle surface with a small amount of the liquid adhering thereto is wiped.

With this configuration, the control portion adjusts the amount of wiping solution to be held in the contact region of the strip-shaped member to correspond to the amount of liquid adhering to the nozzle surface. It is thus possible to reduce the concern that the ejecting state in which the liquid is ejected from the nozzle after the wiping operation becomes unstable.

B. In the liquid ejecting apparatus, the control portion may reduce the amount of the wiping solution held in the contact region by reducing the amount of the wiping solution supplied to the strip-shaped member before the wiping operation is performed.

With this configuration, the control portion reduces the amount of wiping solution held in the contact region by reducing the amount of wiping solution to be supplied to the strip-shaped member. In other words, it is possible to easily adjust the amount of wiping solution held in the contact region by adjusting the amount of wiping solution to be supplied to the strip-shaped member.

C. In the liquid ejecting apparatus, the control portion may reduce the amount of the wiping solution held in the contact region by extending a time interval from when the wiping solution is supplied to the strip-shaped member to when the wiping operation is performed.

The strip-shaped member can absorb the liquid. Therefore, the wiping solution that has been supplied to the strip-shaped member spreads to the surroundings with elapse of time. With this configuration, the control portion reduces the amount of wiping solution to be held in the contact region by extending the time interval from when the wiping solution is supplied to the strip-shaped member to when the wiping is performed. It is thus possible to easily adjust the amount of wiping solution to be held in the contact region.

D. In the liquid ejecting apparatus, when a portion of the contact region that comes into contact with the nozzle surface first in the wiping operation is defined as a front-side contact portion, the control portion may reduce the amount of the wiping solution held in the front-side contact portion by extending the distance between the front-side contact portion and a catching portion of the strip-shaped member that receives the wiping solution supplied before the wiping operation is performed.

With this configuration, the control portion reduces the amount of wiping solution to be held in the front-side contact portion by extending the distance between the catching portion and the front-side contact portion. In the contact region, the front-side contact portion comes into contact with the nozzle surface first in the wiping operation. Therefore, the liquid adhering to the nozzle surface is likely to be collected at the front-side contact portion. It is possible to facilitate absorption of the liquid adhering to the nozzle surface into the strip-shaped member by reducing the amount of wiping solution to be held in the front-side contact portion when the amount of liquid adhering to the nozzle surface is large as compared with that when the amount of liquid adhering to the nozzle surface is small.

E. In the liquid ejecting apparatus, when the wiping operation is successively performed twice, the control portion may reduce the amount of the wiping solution held in the contact region in the wiping operation performed first as compared with the amount of the wiping solution held in the contact region in the wiping operation performed next.

The liquid adhering to the nozzle surface is reduced through the wiping operation. Therefore, the amount of liquid adhering to the nozzle surface before the first wiping operation is performed is larger than the amount of liquid adhering to the nozzle surface before the next wiping operation is performed after the first wiping operation ends. The control portion reduces the amount of wiping solution to be held in the contact region in the first wiping operation as compared with the amount of wiping solution to be held in the contact region in the next wiping operation. It is thus possible to reduce the concern that the ejecting state in which the liquid is ejected from the nozzle becomes unstable after the wiping operation even when the wiping operation is successively performed.

F. According to a maintenance method for a liquid ejecting apparatus, the liquid ejecting apparatus includes a liquid ejecting portion configured to eject a liquid from a nozzle disposed in a nozzle surface, a wiping mechanism configured to execute a wiping operation of wiping the nozzle surface with a strip-shaped member, which is configured to absorb the liquid ejected by the liquid ejecting portion, in contact with the nozzle surface, and a wiping solution supply mechanism configured to supply a wiping solution to the strip-shaped member before the wiping operation is performed, and the method includes: reducing the amount of the wiping solution held in a contact region of the strip-shaped member that comes into contact with the nozzle surface in the wiping operation when the nozzle surface with a large amount of the liquid adhering thereto is wiped as compared with the amount of the wiping solution when the nozzle surface with a small amount of the liquid adhering thereto is wiped. According to this method, it is possible to achieve effects similar to those of the aforementioned liquid ejecting apparatus.

G. In the maintenance method for a liquid ejecting apparatus, the amount of the wiping solution held in the contact region may be reduced by reducing the amount of the wiping solution to be supplied to the strip-shaped member before the wiping operation is performed. According to this method, it is possible to achieve effects similar to those of the aforementioned liquid ejecting apparatus.

H. In the maintenance method for a liquid ejecting apparatus, the amount of the wiping solution held in the contact region may be reduced by extending a time interval from when the wiping solution is supplied to the strip-shaped member to when the wiping operation is performed. According to this method, it is possible to achieve effects similar to those of the aforementioned liquid ejecting apparatus.

I. In the maintenance method for a liquid ejecting apparatus, when a portion of the contact region that comes into contact with the nozzle surface first in the wiping operation is defined as a front-side contact portion, the amount of the wiping solution held in the front-side contact portion may be reduced by extending the distance between the front-side contact portion and a catching portion of the strip-shaped member that receives the wiping solution supplied before the wiping operation is performed. According to this method, it is possible to achieve effects similar to those of the aforementioned liquid ejecting apparatus.

J. In the maintenance method for a liquid ejecting apparatus, when the wiping operation is successively performed twice, the amount of the wiping solution held in the contact region in the wiping operation performed first may be reduced as compared with the amount of the wiping solution held in the contact region in the wiping operation performed next. According to this method, it is possible to achieve effects similar to those of the aforementioned liquid ejecting apparatus.

What is claimed is:

1. A maintenance method for a liquid ejecting apparatus that includes:

a liquid ejecting portion configured to eject a liquid from a nozzle disposed in a nozzle surface, wiping mechanism configured to execute a wiping operation of wiping the nozzle surface with a strip-shaped member, which is configured to absorb the liquid ejected by the liquid ejecting portion, in contact with the nozzle surface, and a wiping solution supply mechanism configured to supply a wiping solution to the strip-shaped member before the wiping operation is performed, the method comprising:

reducing an amount of the wiping solution held in a contact region of the strip-shaped member that comes into contact with the nozzle surface in the wiping operation when the nozzle surface with a large amount of the liquid adhering to the nozzle surface is wiped as compared with the amount of the wiping solution when the nozzle surface with a small amount of the liquid adhering to the nozzle surface is wiped, wherein the amount of the wiping solution held in the contact region is reduced by extending a time interval from when the wiping solution is supplied to the strip-shaped member to when the wiping operation is performed.

2. The maintenance method for a liquid ejecting apparatus according to claim 1, wherein the amount of the wiping solution held in the contact region is reduced by reducing an amount of the wiping solution to be supplied to the strip-shaped member before the wiping operation is performed.

3. The maintenance method for a liquid ejecting apparatus according to claim 1, wherein when a portion of the contact region that comes into contact with the nozzle surface first in the wiping operation is defined as a front-side contact portion and a portion of the strip-shaped member that receives the wiping solution is defined as a catching portion, an amount of the wiping solution that reaches from the catching portion to the front-side-contact portion is reduced by extending a distance between the front-side contact portion and the catching portion.

* * * * *